United States Patent [19]

Nishijima

[11] Patent Number: 5,017,465

[45] **Date of Patent: * May 21, 1991**

[54] LIGHT-SENSITIVE SILVER HALIDE PHOTOGRAPHIC MATERIAL

[75] Inventor: Toyoki Nishijima, Odawara, Japan

[73] Assignee: Konica Corporation, Tokyo, Japan

[ * ] Notice: The portion of the term of this patent subsequent to Mar. 21, 2006 has been disclaimed.

[21] Appl. No.: 138,283

[22] Filed: Dec. 24, 1987

[30] Foreign Application Priority Data

Dec. 27, 1986 [JP] Japan ..... 61-314146
Oct. 1, 1987 [JP] Japan ..... 62-245824

[51] Int. Cl.[5] ..... G03C 1/34; G03C 7/38

[52] U.S. Cl. ..... 430/551; 430/558; 430/567; 430/613; 430/614; 430/615

[58] Field of Search ..... 430/567, 558, 551, 386, 430/387, 372, 614, 615, 613

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/567 |
| 4,564,591 | 1/1986 | Tanaka et al. | 430/567 |
| 4,639,415 | 1/1987 | Kaneko et al. | 430/558 |
| 4,741,980 | 5/1988 | Kaneko | 430/17 |
| 4,752,561 | 6/1988 | Nishijima et al. | 430/558 |
| 4,814,262 | 3/1989 | Sugita et al. | 430/551 |

FOREIGN PATENT DOCUMENTS

| | | | |
|---|---|---|---|
| 0178794 | 4/1986 | European Pat. Off. . | |
| 0232624 | 8/1987 | European Pat. Off. | 430/551 |
| 1249055 | 11/1986 | Japan | 430/551 |
| 2024255 | 2/1987 | Japan | 430/551 |
| 2169161 | 7/1987 | Japan | 430/551 |
| 2174759 | 7/1987 | Japan | 430/551 |
| 2211649 | 9/1987 | Japan | 430/558 |
| 2212652 | 9/1987 | Japan | 430/551 |
| 2215273 | 9/1987 | Japan | 430/551 |
| 2215954 | 9/1987 | Japan | 430/551 |
| 2229148 | 10/1987 | Japan | 430/551 |

*Primary Examiner*—Charles L. Bowers, Jr
*Assistant Examiner*—Lee C. Wright
*Attorney, Agent, or Firm*—Jordan B. Bierman

[57] ABSTRACT

A light-sensitive silver halide photographic material comprising a support having at least one silver halide emulsion layer thereon, wherein at least one said silver halide emulsion layer contains silver halide grains having a silver chloride content of not less than 80 mol %, a magenta dye-forming coupler represented by Formula (M-I), and at least one compound in accordance with Formulas (A) and (B);

FORMULA (M-I)

FORMULA (B)

FORMULA (A)

wherein the substituents are as defined in the specification.

7 Claims, No Drawings

LIGHT-SENSITIVE SILVER HALIDE PHOTOGRAPHIC MATERIAL

FIELD OF THE INVENTION

The present invention relates to a light-sensitive silver halide photographic material feasible for the rapid processing and improved in the color reproducibility and light-fastness of dye images.

BACKGROUND OF THE INVENTION

Recent years, desired in the present industrial field are light-sensitive silver halide photographic materials (hereinafter referred to often as "light-sensitive material(s)") having a high image quality and capable of being rapidly processed.

As for the image quality of the dye images obtained from a light-sensitive material, that is required is that there can be achieved a food color reproducibility and good light-fastness.

Both the feasibility for rapid processing and the color reproducibility ca be satisfied by the combination of a silver halide emulsion of the composition rich in silver chloride and a magenta coupler of the pyrazoloazole type, but the light-fastness may become poor. Techniques for improving the light-fastness of a magenta dye image by use of a piperazine type antioxidant or hindered amine type antioxidant are disclosed in Japanese Patent publication Open to public Inspections (hereinafter referred to as "Japanese Unexamined Patent publication(s)") No. 72246/1986, No. 73152/1986, No. 189539/1986, No. 180367/1987, etc. However, these methods, although can attain a great effect of improving the light-fastness, are accompanied with disadvantages such that the rapid processing feasibility becomes lower and there occurs an increase in the white area yellowing caused by light. Also, a phenol type antioxidant may not impair the rapid processing feasibility (as disclosed in Japanese Patent O.P.I. publications No. 125732/1984, No. 26215/1985, No. 184543/1986, No. 186960/1986, No. 194444/1986, No. 241753/1986, etc.), but can have only a small effect of improving the light-fastness.

Accordingly, it is demanded to bring forth a color light-sensitive material that can be excellent in the color reproducibility, light-fastness and rapid processing feasibility, and also may suffer less yellowing of the white area.

SUMMARY OF THE INVENTION

An object of the present invention is to provide a color light-sensitive material improved in the color reproducibility. light-fastness of dye images and color-forming performance, feasible for the rapid processing, and also suffering less yellowing of the white area.

The above object of the present invention can be achieved by a light-sensitive material comprising a support and at least one silver halide emulsion layer provided thereon, wherein at least one layer of said silver halide emulsion layer contains silver halide grains containing 80 mol % or more of silver chloride, a magenta coupler represented by Formula (M-I) shown below, and a compound represented by Formula (A-O) shown below.

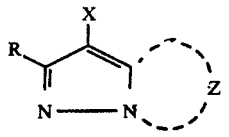

Formula (M-I)

wherein Z represents a group of non-metallic atoms necessary for the formation of a nitrogen-containing heterocyclic ring, which ring formed by Z may have a substituent; X represents a hydrogen atom or a group capable of being split off through the reaction with an oxidized product of a color developing agent; and R represents a hydrogen atom or a substituent.

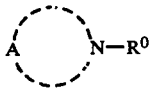

Formula (A0)

wherein A is a group of non-metal atoms necessary to complete a 5-member to 8-member nitrogen-containing ring, and $R^0$ represents an aryl group or a heterocyclic group

DETAILED DESCRIPTION OF THE INVENTION

The present invention will be described below in detail.

In the magenta coupler represented by the above Formula (M-1) according to the present invention, Z represents a group of non-metal atoms necessary for the formation of a nitrogen-containing heterocyclic ring, and the ring formed by Z may have a substituent.

X represents a hydrogen atom or a group capable of being split off through the reaction with an oxidized product of a color developing agent.

And, R represents a hydrogen atom or a substituent.

There is no particular limitation in the substituent represented by R, but it may typically include the groups such as alkyl, aryl, anilino, acylamino, sulfonamide, alkylthio, arylthio, alkenyl and cycloalkyl. Besides these it may also include a halogen atom, the group a such as cycloalkenyl, alkynyl, a heterocyclic ring, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imide, ureido, sulfamoylamino, alkoxycarbonylamino, aryloxycarbonylamino, alkoxycarbonyl, aryloxycarbonyl and heterocyclic thio, and a spiro compound residual group, a bridged hydrocarbon compound residual group, etc.

The alkyl group represented by R may preferably be an alkyl group having 1 to 32 carbon atoms, which may be of straight-chain or branched-chain types.

The aryl group represented by R may preferably be a phenyl group.

The acylamino group represented by R may include an alkylcarbonylamino group, an arylcarbonylamino group, etc.

The sulfonamide group represented by R may include an alkylsulonylamino group, an arylsulfonylamino group, etc.

The alkyl component or aryl component in the alkylthio group or arylthio group represented by R may include the above alkyl group or aryl group represented by R, respectively.

The alkenyl group represented by R may preferably be an alkenyl group having 2 to 32 carbon atoms; and the cycloalkyl group, a cycloalkyl group having 3 to 12, particularly 5 to 7, carbon atoms. The alkenyl group may be of straight-chain or branched-chain types.

The cycloalkenyl group represented by R may preferably be a cycloalkenyl group having 2 to 12, particularly 5 to 7, carbon atoms.

The sulfonyl group represented by R may include an alkylsulfonyl group, an arylsulfonyl group, etc.;

the sulfinyl group, an alkylsulfinyl group, an arylsulfinyl group etc.;

the phosphonyl group, an alkylphosphonyl group, an alkoxyphosphonyl group, an aryloxyphosphonyl group, an arylphosphonyl group, etc.; the acyl group, an alkylcarbonyl group, an arylcarbonyl group, etc.;

the carbamoyl group, an alkylcarbamoyl group, an arylcarbamoyl group, etc.;

the sulfamoyl group, an alkylsulfamoyl group, an alkylsulfamoyl group, etc.;

the acyloxy group, an alkylcarbonyloxy group, an arylcarbonyloxy group, etc.;

the carbamoyloxy group, an alkylcarbamoyloxy group, an arylcarbamoyloxy group, etc.;

the ureido group, an alkylureido group, an arylureido group, etc ;

the sulfamoylamino group, an alkylsulfamoylamino group, an arylsulfamoylamino group, etc.;

the heterocyclic group may preferably be a heterocyclic group of 5 to 7 members, specifically a 2-furyl group, a 2-thienyl group, a 2-pyrimidinyl group, a 2-benzothiazolyl group, etc.;

the heterocyclic oxy group may preferably be a heterocyclic oxy group having a heterocyclic ring of 6 to 7 members, for example, a 3,4,5,6 tetrahydropyranyl-2-oxy group, a 1-phenyltetrazole-5-oxy group, etc.;

the heterocyclic thio group may preferably be a heterocyclic thio group of 5 to 7 members, for example, a 2-pyridylthio group, a 2-benzothiazolylthio group, a 2,4-diphenoxy-1,3,5-triazole-6-thio group, etc.;

the siloxy group, a trimethylsiloxy group, a triethylsiloxy group, a dimethylbutylsiloxy group, etc.:

the imide group, a succinimide group, a 3 heptadecylsuccinimide group, a phthalimide group, a glutalimide group, etc.:

the spiro compound residual group, spiro[3.3]heptan-1-yl, etc. and the bridged hydrocarbon compound residual group, bicyclo[2.2.1]heptan-1-yl, tricyclo[3.3.1$^{3,7}$]decan-1-yl, 7,7-dimethyl-bicyclo[2.2.1]heptan-1-yl, etc.

The group capable of being split off through the reaction with an oxidized product of a color developing agent may include, for example, a halogen atom (such as a chlorine atom, a bromine atom and a fluorine atom) and the groups such as alkoxy, aryloxy, heterocyclic oxy, acyloxy, sulfonyloxy, alkoxycarbonyloxyl, aryloxycarbonyl, alkyloxazyloxy, alkoxyoxazyloxy, alkyl thio, arylthio, heterocyclic thio, alkyloxythiocarbonylthio, acylamino, sulfonamide, a nitrogen-containing heterocyclic ring linked with an N atom, alkyloxycarbonylamino, aryloxycarbonylamino, carboxyl and

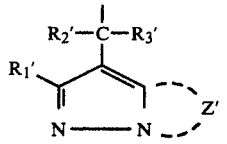

($R_1'$ has the same definition as in the above R: Z' has the same definition as the above Z and $R_2$ and $R_3$ each represents a hydrogen atom, an aryl group, an alkyl group or a heterocyclic group), but preferably includes a halogen atom, particularly a chlorine atom.

The nitrogen-containing heterocyclic ring formed by Z or Z' may include a pyrazole ring, an imidazole ring, a triazole ring or tetrazole ring, etc., and the substituent the above ring may have may include those described for the above R.

The magenta coupler represented by Formula (M-I) is more specifically represented by, for example, Formulas (M-II) to (M-VII) shown below, respectively.

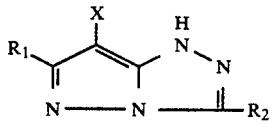

Formula (M-II)

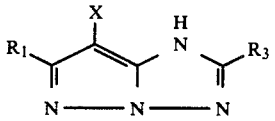

Formula (M-III)

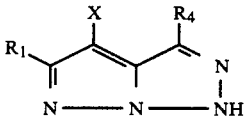

Formula (M-IV)

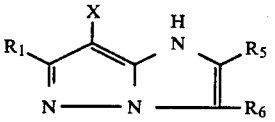

Formula (M-V)

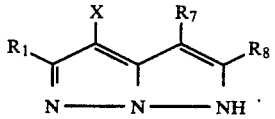

Formula (M-VI)

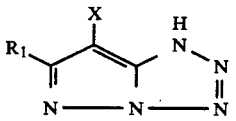

Formula (M-VII)

In the above Formulas (M-II) to (M-VII), $R_1$ to $R_8$ and X have the same definition as the above R and X, respectively.

Most preferred among Formula (M-I) is a compound represented by Formula (M-VIII) shown below.

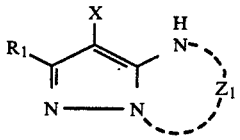

Formula (M-VIII)

In the formula, $R_1$, X and $Z_1$ have the same definition as R, X and Z in Formula (M-I), respectively.

Of the magenta couplers represented by Formulas (MII) to (M-VII), particularly preferred is the magenta coupler represented by Formula (M II).

Most preferred as the substituents R and $R_1$ on the above heterocyclic ring is a substituent represented by Formula (M-IX) shown below.

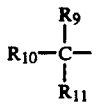

Formula (M-IX)

In the formula, $R_9$, $R_{10}$ and $R_{11}$ each have the same definition as the above R.

Any two of the above $R_9$, $R_{10}$ and $R_{11}$, for example, $R_9$ and $R_{10}$ may be combined to form a saturated or unsaturated ring (for example, cycloalkane, cycloalkene or a heterocyclic ring), or $R_{11}$ may further be combined to said ring to constitute a bridged hydrocarbon compound residual group.

Particularly preferred among Formula (M-IX) is (i) an instance in which at least two of $R_9$ to $R_{11}$ are each an alkyl group, and (ii) an instance in which any one of $R_9$ to $R_{11}$, for example, $R_{11}$ is a hydrogen atom and the other two of $R_9$ and $R_{10}$ are combined to form a cycloalkyl together with a route carbon atom.

Further preferred among (i) is an instance in which any two of $R_9$ to $R_{11}$ are each an alkyl group and the other one is a hydrogen atom or an alkyl group.

The substituent the ring formed by Z in Formula (M-1) or the ring formed by $Z_1$ in Formula (M-VIII) may have and $R_2$ to $R_8$ In Formulas (M-II) to (M-VI) may preferably be a compound represented by Formula (X) shown below.

$$-R_{12}-SO_2-R_{13}-$$

Formula (M-X)

In the formula, $R_{12}$ represents an alkylene group, and $R_{13}$ represents a cycloalkyl group or an aryl group.

The alkylene group represented by $R_{12}$ may preferably have a carbon atom number of 2 or more, more preferably 3 to 6, at the part of the straight-chain, and may be of either straight-chain or branched chain types.

The cycloalkyl group represented by $R_{13}$ may preferably be a cycloalkyl group of 5 or 6 members.

Typical examples of the above compounds according to the present invention are shown below.

M-1

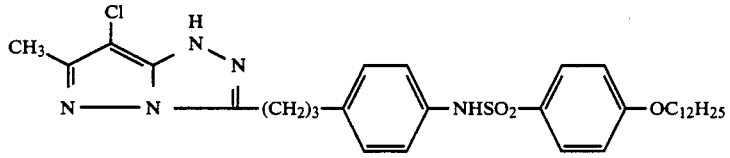

M-2

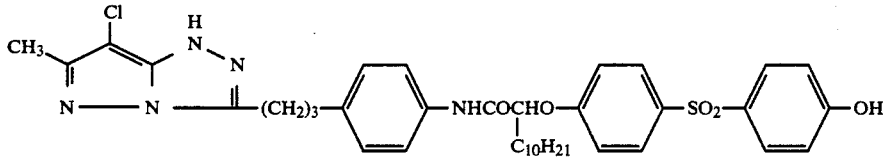

M-3

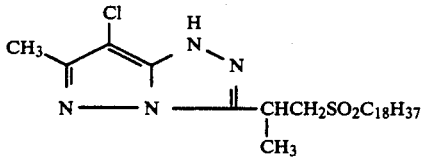

M-4

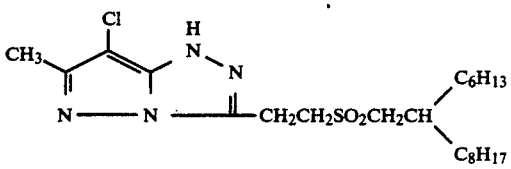

M-5

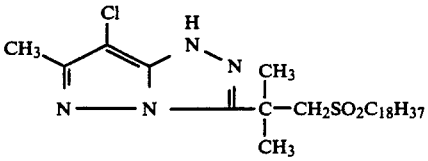

-continued
M-6
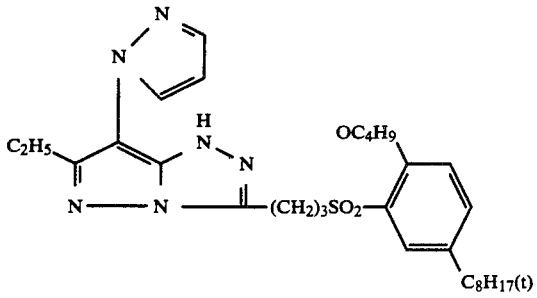
M-7
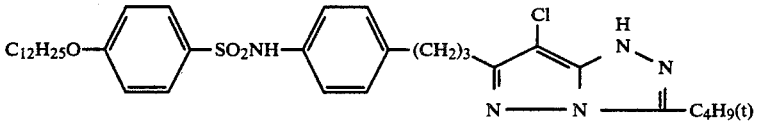
M-8
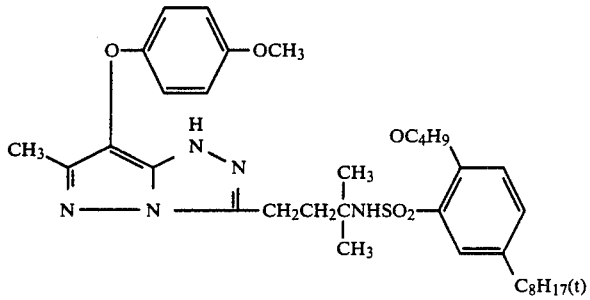
M-9
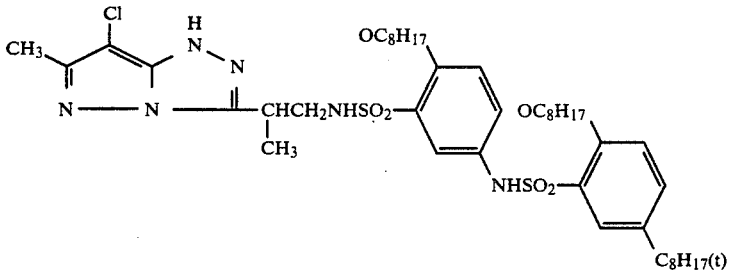
M-10
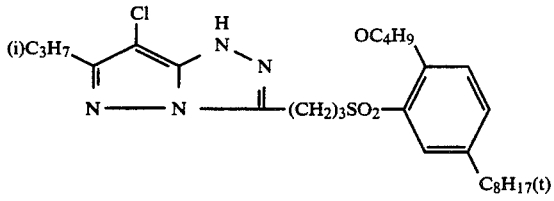
M-11
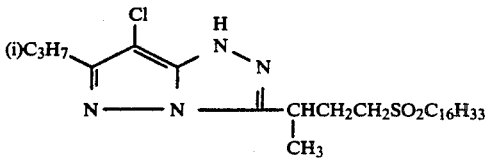
M-12
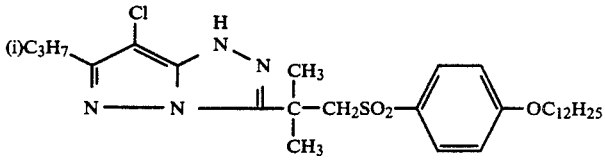

-continued
M-13
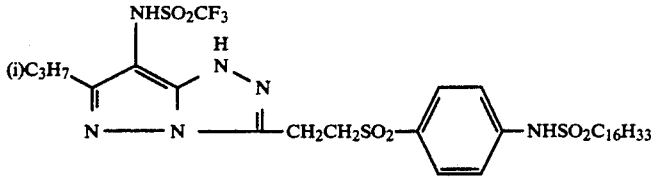
M-14
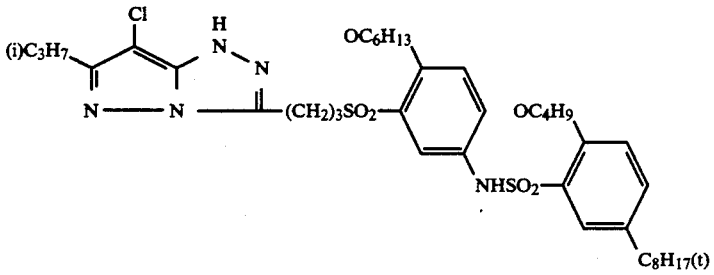
M-15
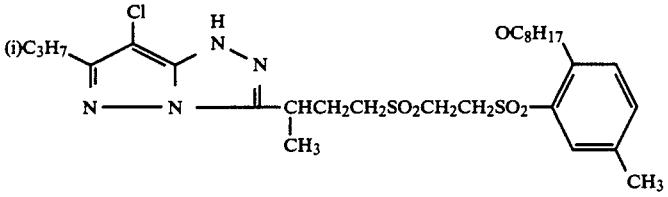
M-16
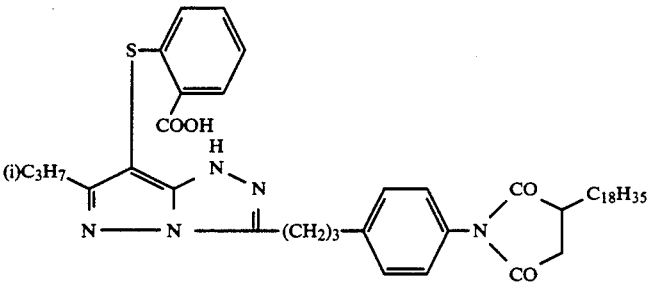
M-17
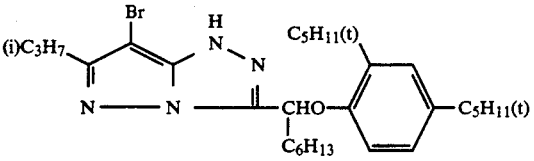
M-18
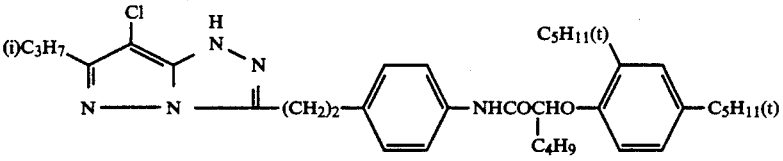
M-19
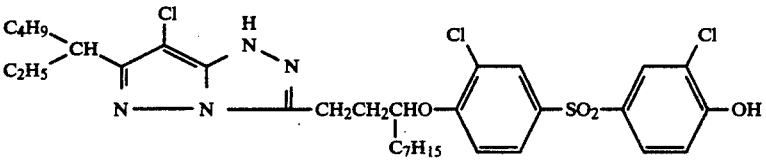
M-20
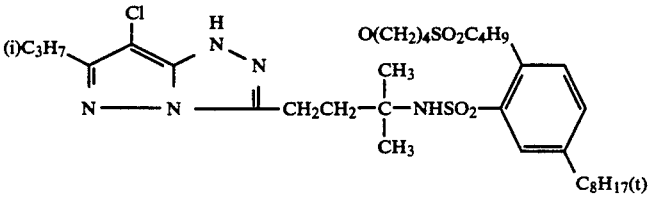

-continued
M-21
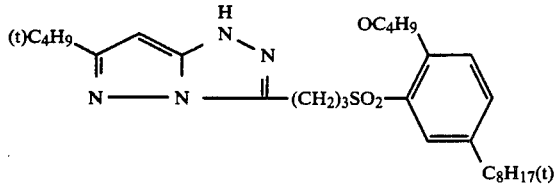
M-22
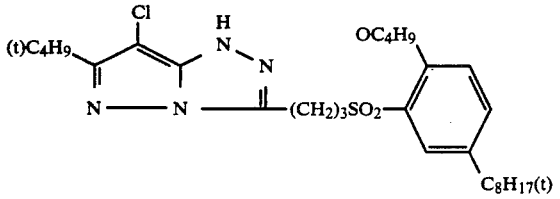
M-23
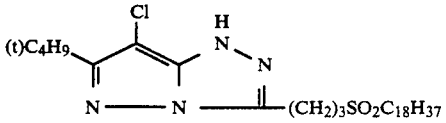
M-24
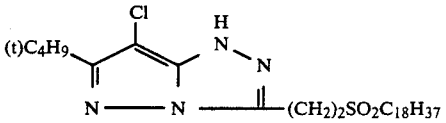
M-25
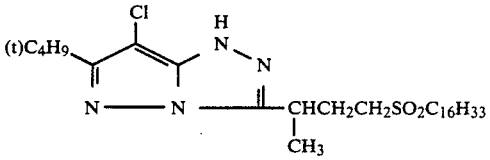
M-26
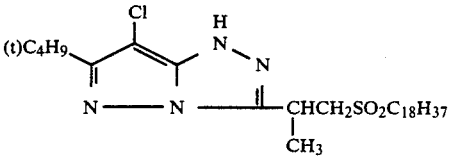
M-27
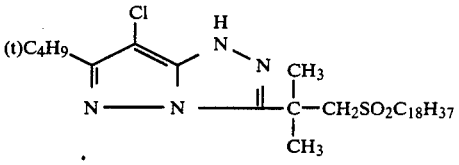
M-28
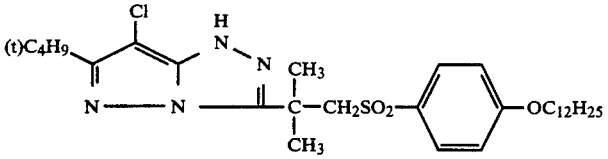
M-29
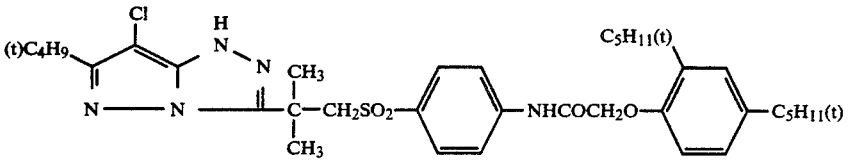
M-30
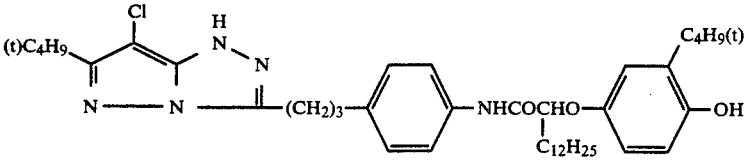

-continued
M-31
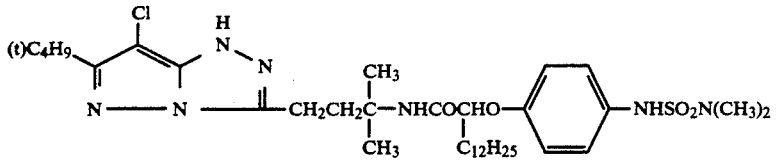
M-32
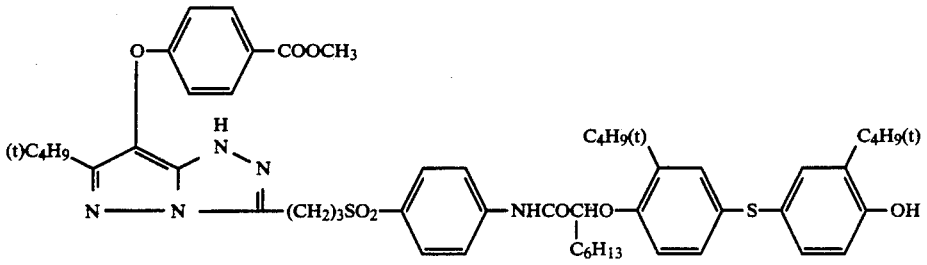
M-33
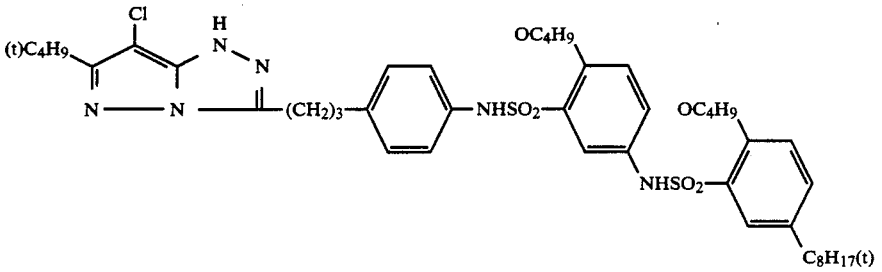
M-34
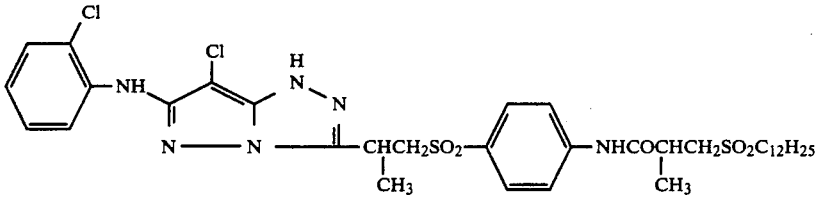
M-35
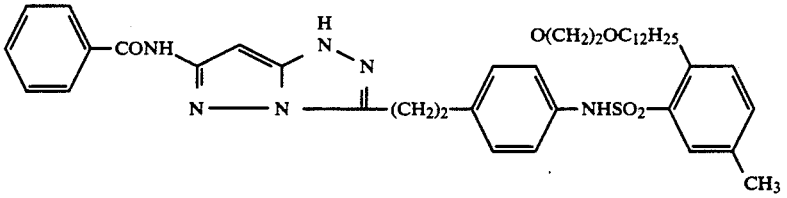
M-36
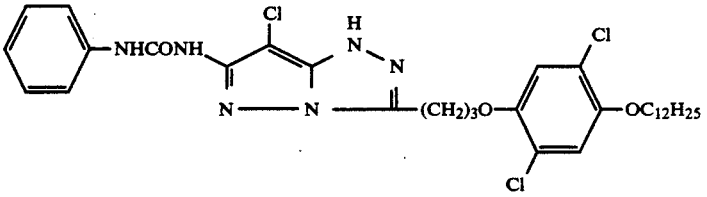
M-37
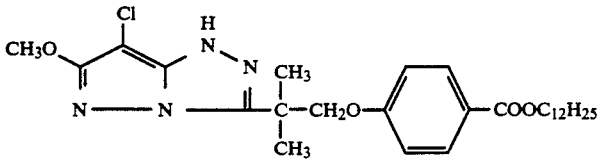

-continued
M-38
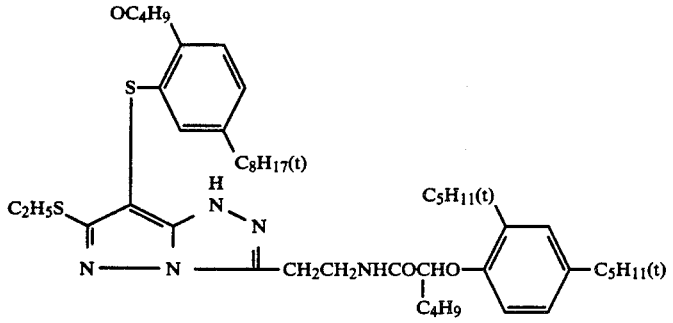
M-39
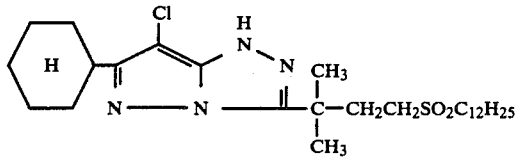
M-40
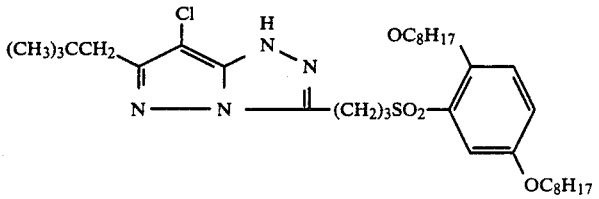
M-41
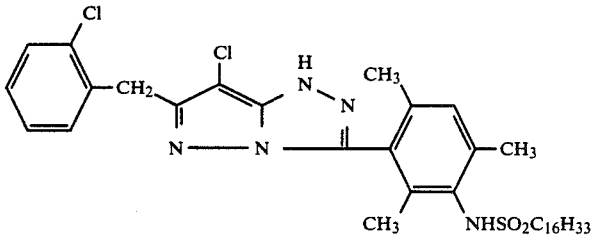
M-42
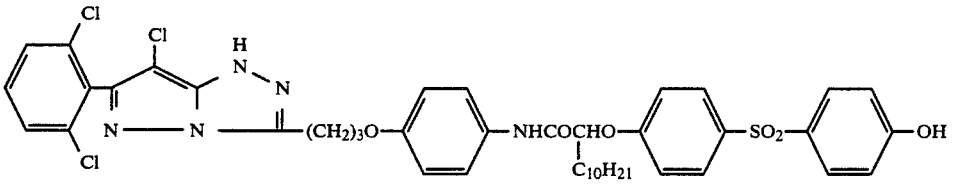
M-43
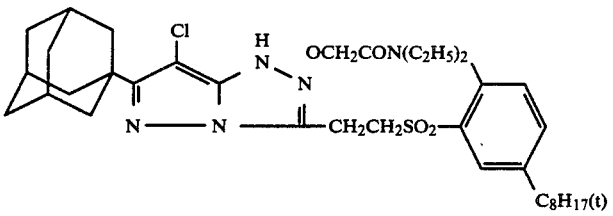
M-44
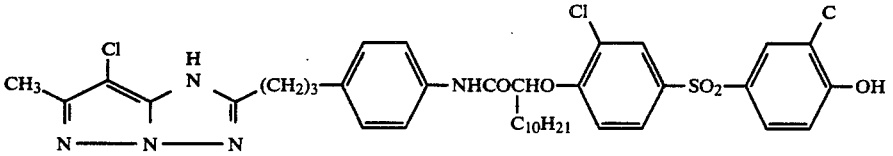
M-45
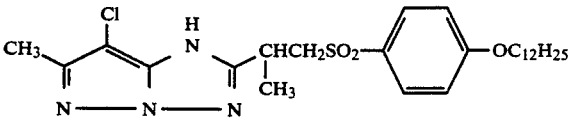

-continued
M-46
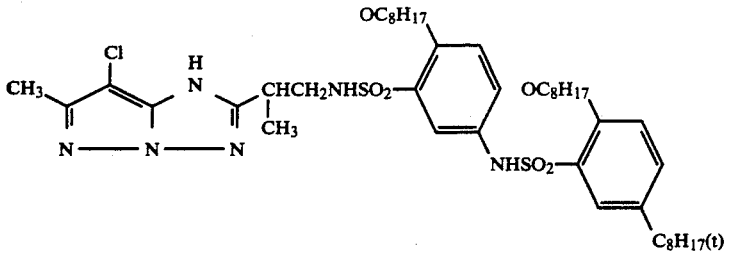
M-47
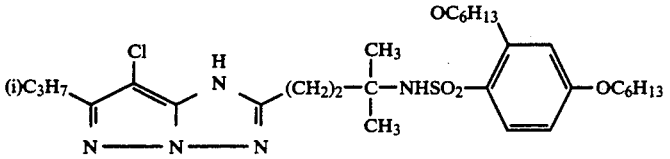
M-48
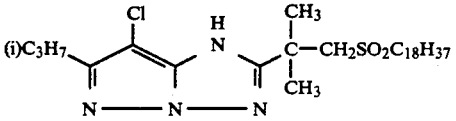
M-49
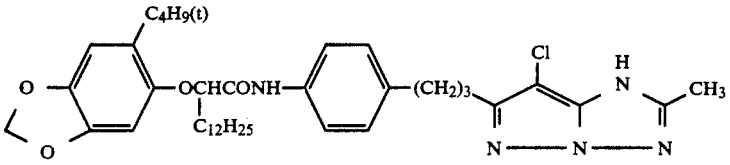
M-50
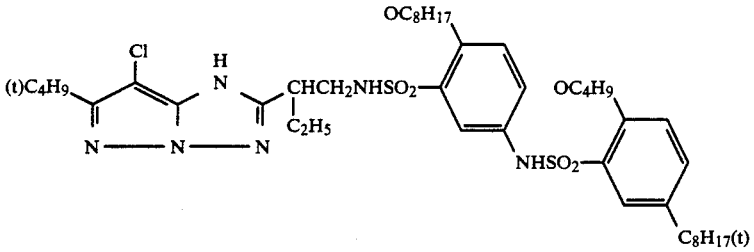
M-51
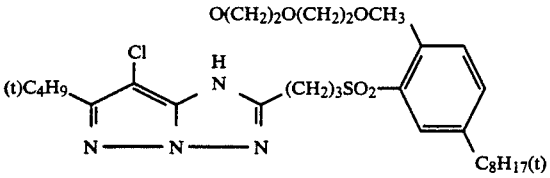
M-52
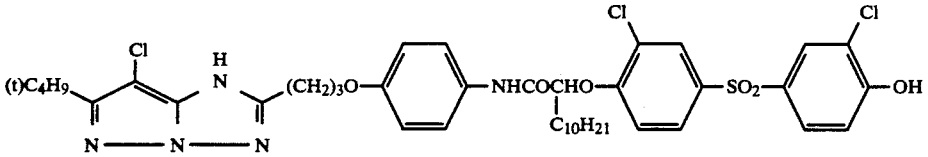
M-53
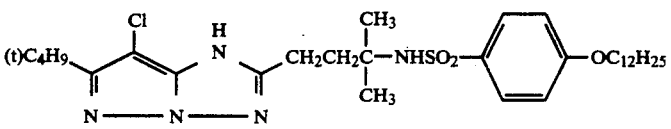
M-54
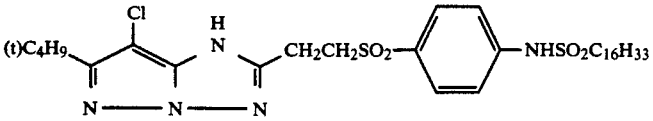

-continued

M-55

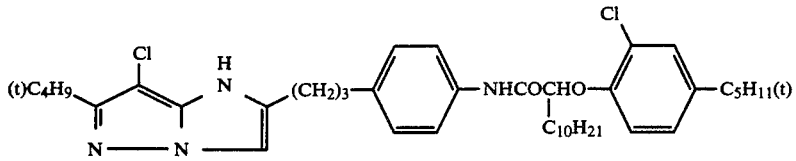

M-56

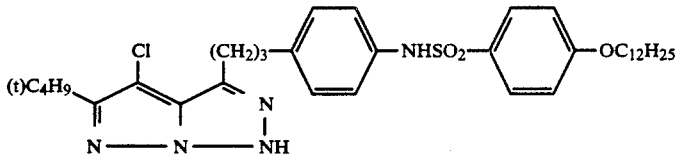

M-57

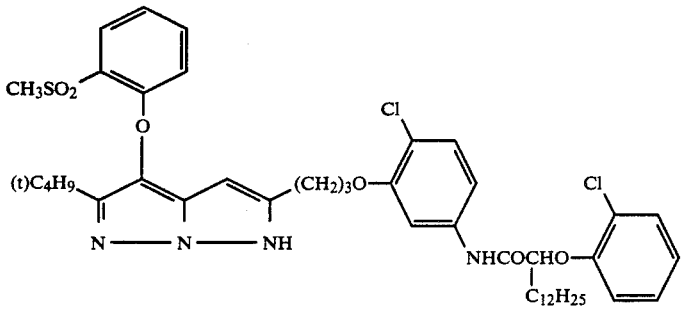

M-58

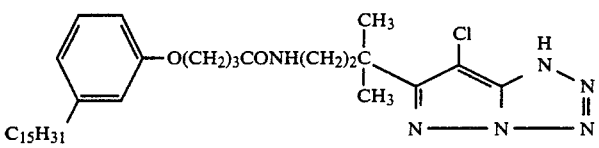

M-59

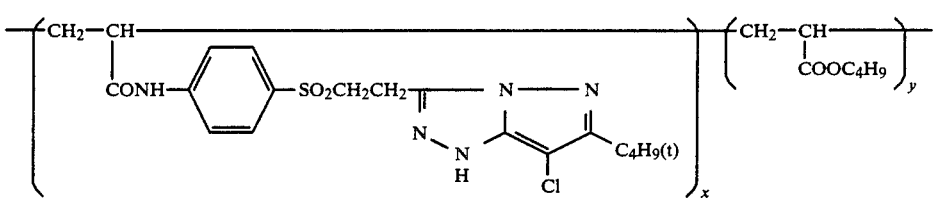

x:y = 50:50

M-60

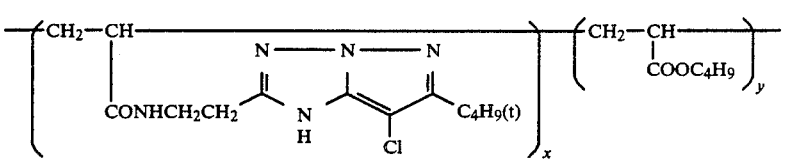

x:y = 50:50

M-61

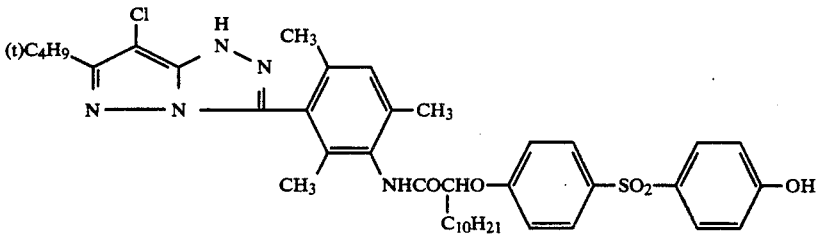

In addition to the above typical examples of the compound according to the present invention, examples of the compound according to the present invention may also include the compounds shown as Nos. 1 to 4, 6, 8 to 17, 19 to 24, 26 to 43, 45 to 59, 61 to 104, 106 to 121, 123 to 162 and 164 to 223 among the compounds described in Japanese Patent O.P.I. Publication No. 16339/1987.

The above couplers can be also synthesized by making reference to Journal of the Chemical Society, Perkin 1 (1977), 2047–2052, U.S. Pat. No. 3,725,067, Japanese patent O.P.I. publications No. 99437/1984, No. 42045/1983, No. 162548/1984, No. 171956/1984, No. 33552/1985, No. 43659/1985, No. 172982/1985, No. 190779/1985, etc.

The couplers of the present invention can be used usually in the range of $1\times10^{-3}$ mol to 1 mol, preferably $1\times10^{-2}$ mol to $8\times10^{-1}$ mol, per mol of silver halide.

The couplers of the present invention can be used in combination with magenta couplers of different kinds.

The anti-color-fading agent represented by the above Formula (AO) and is used in combination with the magenta coupler of the present invention will be described below.

When the compound represented by the above Formula (AO) (hereinafter referred to also "magenta dye image stabilizing agent of the present invention") contained in the light-sensitive silver halide photographic material of the present invention is used in combination with the magenta coupler of the present invention, there can be obtained not only the effect of preventing the magenta dye image from being color-faded owing to light but also the effect of preventing the white area from being yellowed owing to light.

In the present invention, the compound represented by Formula (AO) is more specifically represented by Formula (A) or Formula (B) shown below.

Formula (A)

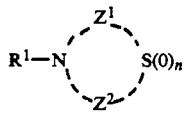

wherein $R^1$ represents an aryl group or a heterocyclic group; and $Z^1$ and $Z^2$ each represent an alkylene group having 1 to 3 carbon atom, provided that the total sum of the carbon atom number of the alkylene group represented by $Z^1$ and $Z^2$ each is 3 to 6; and n represents 1 or 2.

Formula (B)

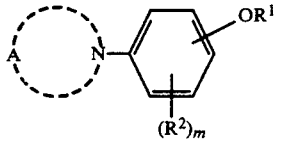

wherein $R^1$ represents an alkyl group, a cycloalkyl group, an alkenyl group, an aryl group, a heterocyclic group, an acyl group, a bridged hydrocarbon group, an alkyl sulfonyl group or an aryl sulfonyl group; $R^2$ represents a group capable of being substituted on the benzene ring; m represents an integer of 0 to 4, provided that a plurality of $R^2$ may be the same or different when m is 2 or more or may form a ring with each other, or $R^2$ may form a ring together with —$OR^1$ (wherein $R^1$ is as defined above); and A represents a group of non-metal atoms necessary for the formation of a 5- to 8-membered ring together with a nitrogen atom.

In the above Formula (A), the aryl group represented by $R^1$ may include, for example, a phenyl group, a 1-naphthyl group, etc., and these aryl groups may have a substituent. The substituent may include the substituents such as those set out as the substituents of R in Formula (M-I).

The heterocyclic group represented by $R^1$ may include, for example, a 2-furyl group, a 2-thienyl group, etc., and these heterocyclic groups include those having the substituent such as those set out for R in Formula (M-I).

$Z^1$ and $Z^2$ each represent an alkylene group having 1 to 3 carbon atoms, provided that the total sum of the carbon atom number of the alkylene group represented by $Z^1$ and $Z^2$ each is 3 to 6. These alkylene groups may have the substituent such as those set out for R in Formula (M-I).

The symbol n represents 1 or 2.

Particularly preferred in the present invention is the compound wherein, in the above Formula (A), $R^1$ is a phenyl group, $Z^1$ and $Z^2$ each are an ethylene group, and n is 2.

Examples of the magenta dye image stabilizing agent of the present invention are shown below.

| Comp. | $R^{1'}$ | m | $R^{1''}$ | l |
|---|---|---|---|---|
| | | | 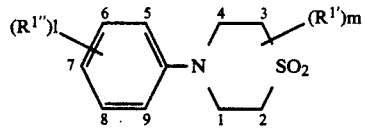 | |
| A-1 | — | 0 | 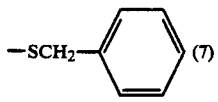 | 1 |
| A-2 | — | 0 | $-OC_8H_{17}$ (7) | 1 |
| A-3 | — | 0 | $-OC_{12}H_{25}$ (7) | 1 |
| A-4 | — | 0 | $-OC_{14}H_{28}$ (7) | 1 |
| A-5 | — | 0 | $-OC_{16}H_{33}$ (7) | 1 |
| A-6 | — | 0 | $-OC_{12}H_{25}$ (5) | 1 |
| A-7 | — | 0 | 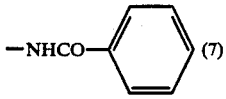 | 1 |
| A-8 | — | 0 | $-OCH_3$ (6,8) | 2 |

-continued
| Comp. | $R^{1'}$ | m | $R^{1''}$ | l |
|---|---|---|---|---|
| A-9 | — | 0 | $-N(C_2H_5)(C_6H_{13})$ (7) | 1 |
| A-10 | — | 0 | $-OC_{12}H_{25}$ (7), —Cl (6) | 2 |
| A-11 | — | 0 | $-OC(=O)C_{13}H_{27}$ (7) | 1 |
| A-12 | — | 0 | $-C_{12}H_{25}$ (7) | 1 |
| A-13 | — | 0 | $-NHCOOC_{12}H_{25}$ (5) | 1 |
| A-14 | $-CH_3$ (1,1,4,4) | 4 | $-OC_{12}H_{25}$ (7) | 1 |
| A-15 | $-CH_3$ (2,2,3,3) | 4 | $-OC_{16}H_{25}$ (7) | 1 |
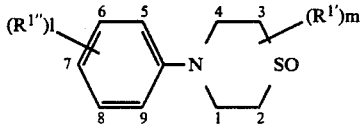
| | | | | |
|---|---|---|---|---|
| A-16 | — | 0 | $-OC_{12}H_{25}$ (7) | 1 |
| A-17 | — | 0 | $-OCH_2-C_6H_4$ (7) | 1 |
| A-18 | — | 0 | $-NHSO_2C_{16}H_{33}$ (5) | 1 |
| A-19 | $-CH_2OH$ (1) | 1 | $-OC(=O)C_{13}H_{27}$ (6) | 1 |
| A-20 | $-CH_3$ (2,2,3,3,) | 4 | $-OC_{12}H_{25}$ (7) | 1 |
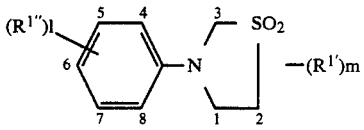
| | | | | |
|---|---|---|---|---|
| A-21 | — | 0 | $-OC_{14}H_{29}$ (6) | 1 |
| A-22 | — | 0 | $-OC_2H_5$ (5,7) | 2 |
| A-23 | — | 0 | $-NHSO_2-C_6H_4-OC_{12}H_{25}$ (6) | 1 |
| A-24 | $-OC_2H_5$ (1) | 1 | $-OC_{12}H_{25}$ (4) | 1 |
| A-25 | $-CH_3$ (3,3) | 2 | $-OCH_2-C_6H_4$ (6) | 1 |
In addition to the above, there can be included the following compounds.
A-26
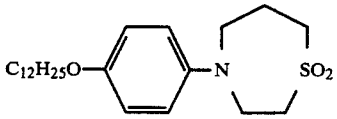
-continued
A-27
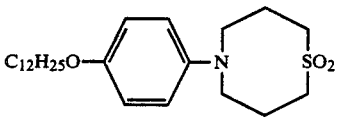
A-28
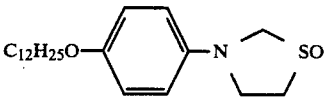

-continued

A-29

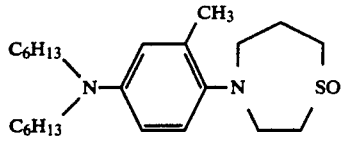

A-30

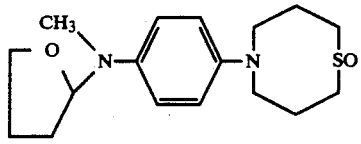

A-31

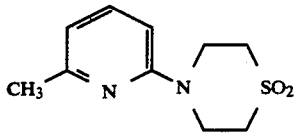

A-32

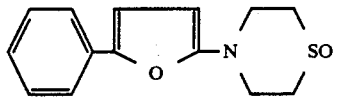

A-33

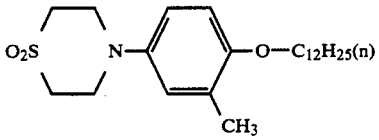

A-34

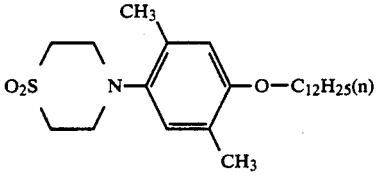

A-35

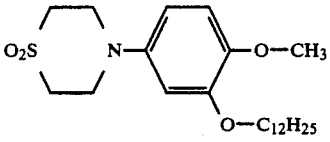

Typical examples for the synthesis of the magenta dye image stabilizing agent of the present invention will be described below.

SYNTHESIS EXAMPLE 1

Synthesis of compound (A-3)

In 200 ml of ethanol, 27 g of p-dodecyloxyaniline and 15 g of divinyl sulfone were dissolved, and the solution was boiled under reflux for 3 hours, followed by ice-cooling to collect by filtration the crystals precipitated, which were recrystallized from ethanol to obtain 18 g of white scaly crystals.

The structure thereof was confirmed by mass spectrum and nuclear magnetic rezonance spectrum.

SYNTHESIS EXAMPLE 2

Synthesis of compound (A-17)

In 150 ml of dioxane, 20 g of p-benzyloxyaniline and 13 g of divinyl sulfoxide were dissolved, and the solution was boiled under reflux for 5 hours, and thereafter allowed to stand for 24 hours to collect by filtration the crystals precipitated, which were recrystallized from ethanol to obtain 15 g of white powdery crystals.

The structure thereof was confirmed by mass spectrum and nuclear magnetic rezonance spectrum.

The above magenta dye image stabilizing agent represented by Formula (A) of the present invention may be used preferably in an amount of 5 to 400 mol %, more preferably 10 to 300 mol %, based on the magenta coupler of the present invention.

The magenta dye image stabilizing agent represented by the above Formula (B) and is used in another embodiment of the present invention in combination with the magenta coupler of the present invention will be described below.

In Formula (B), the alkyl group represented by $R^1$ may include, for example, an straight-chain or branched-chain alkyl group having 1 to 24 carbon atoms; the cycloalkyl group, for example, a cycloalkyl group having 5 to 24 carbon atoms; the alkenyl group, for example, an alkenyl group having 3 to 24 carbon atoms; the aryl group, for example, a phenyl group and a naphthyl group; the heterocyclic group, for example, a pyridyl group, an imidazolyl group and a thiazole group; the acyl group, for example, an acetyl group and a benzoyl group; the bridged hydrocarbon group, for example, a bicyclo[2.2.1]heptyl group, and so forth, respectively.

These groups represented by by $R^1$ include those further having a substituent.

Preferred as $R^1$ is an alkyl group.

The group represented by $R^2$ and capable of being substituted on the benzene ring may typically include a halogen atom and the groups such as alkyl, aryl, alkoxy, aryloxy, alkylthio, arylthio, acyl, alkoxycarbonyl, carbamoyl (for example, alkylcarbamoyl, arylcarbamoyl, etc.), ureido (for example, alkylureido, arylureido, etc.), sulfamoyl (for example, alkylsulfamoyl, arylsulfamoyl, etc.), amino (including substituted amino), alkylsulfonyl, arylsulfonyl, nitro, cyano and carboxy. Of these, preferred as $R^2$ are a halogen atom, an alkyl group and an alkylthio group. The groups represented by $R^2$ may further have a substituent.

The symbol m represents an integer of 0 to 4, but may preferably represent 0 to 2.

The 5- to 8-membered ring formed by A may include the rings such as pyrrolidine, piperidine, piperadine, morpholine and pyridine. These rings include those having a substituent.

The group —$OR^1$ can be located at any position with regard to .

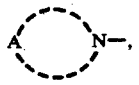

but preferably at the p-position.

Typical examples of the magenta dye image stabilizing agent of the present invention, represented by Formula (B) will be shown below, but by no means limited to these.

(1)

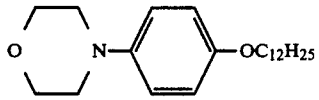

-continued (2)

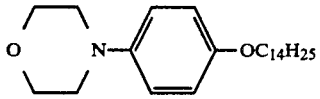

(3)

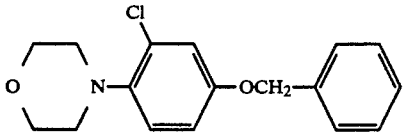

(4)

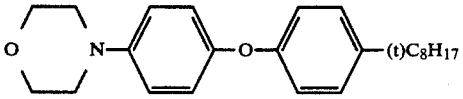

(5)

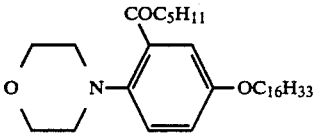

(6)

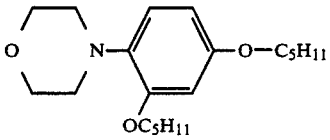

(7)

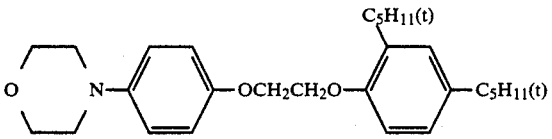

(8)

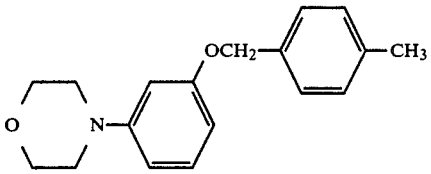

(9)

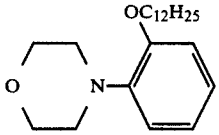

(10)

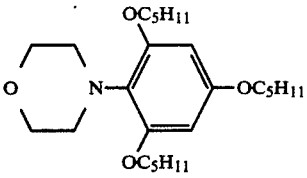

(11)

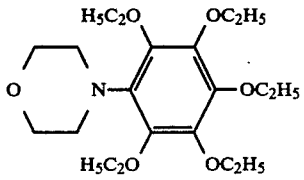

(12)

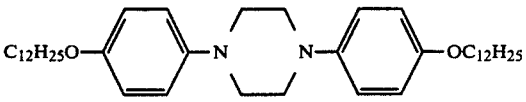

-continued (13)

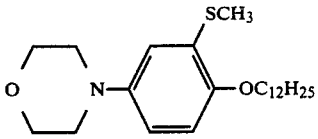

(14)

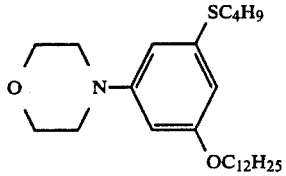

(15)

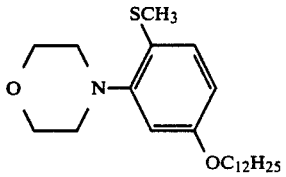

In addition to the above typical compounds of the compound according to the present invention, the compound used in the present invention, the compound used in the present invention may also include the compounds described in Japanese Patent Application No. 241743/1986 (unpublished).

The magenta dye image stabilizing agent represented by Formula (B) of the present invention may be used preferably in an amount of 5 to 300 mol %, more preferably 10 to 200 mol %, based on the magenta coupler of the present invention.

The magenta coupler of the present invention and the magenta dye image stabilizing agent of the present invention may preferably be used in the same layer, but this stabilizing agent may also be used in a layer adjacent to the layer in which said coupler is present.

For the purpose of further improving the light-fastness of the magenta coupler in the light-sensitive silver halide photographic material of the present invention, a phenol type antioxidant represented by Formula (II) shown below may preferably be used in the silver halide emulsion layer containing the magenta coupler.

Formula (II)

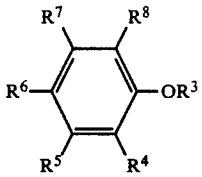

In the formula, $R^3$ represents a hydrogen atom, an alkyl group, an alkenyl group, an aryl group or a heterocyclic group; $R^4$, $R^5$, $R^7$ and $R^8$ each represent a hydrogen atom, a halogen atom, a hydroxyl group, an alkyl group, an alkenyl group, an aryl group, an alkoxy group or an acylamino group; and $R^6$ represents an alkyl group, a hydroxyl group, an aryl group or an alkoxy group. $R^3$ and $R^4$ may be ring-closed each other to form a 5- or 6-membered ring, and $R^6$ in such an instance represents a hydroxyl group or an alkoxy group. Also, $R^3$ and $R^4$ may be ring-closed to form a methylenedioxy ring. Still also, $R^5$ and $R^6$ may be ring-closed to form a 5-membered hydrocarbon ring, and $R^3$ in such an instance represents an alkyl group, an aryl group or a heterocyclic ring, except, however, the instance in which $R^3$ is a hydrocarbon atom and $R^6$ is a hydroxyl group.
Examples of the compound of Formula (II) preferably used in the present invention are shown below.
PH-1
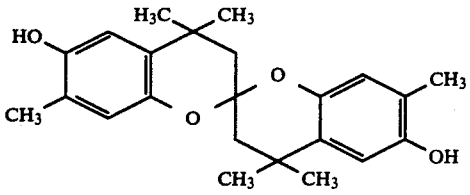
PH-2
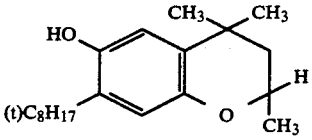
PH-3
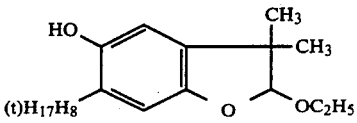
PH-4
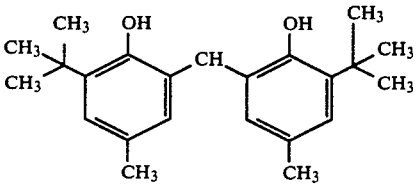
PH-5
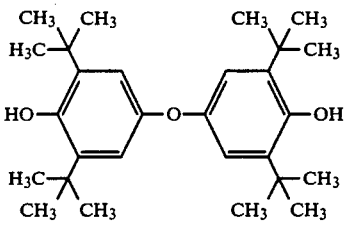
PH-6
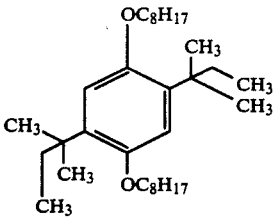
PH-7
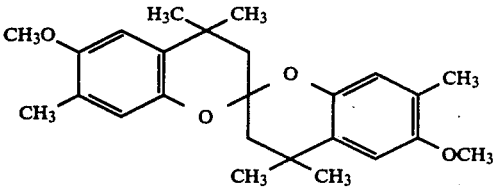
PH-8
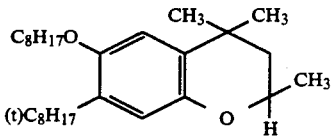
-continued
PH-9
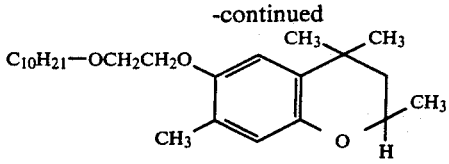
PH-10
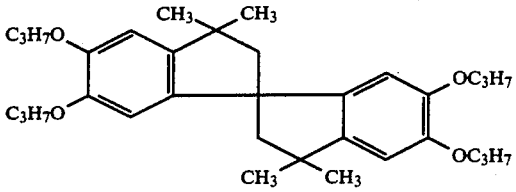
PH-11
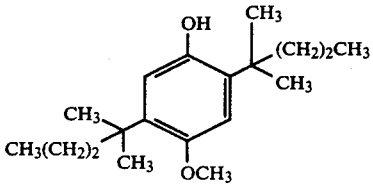
PH-12
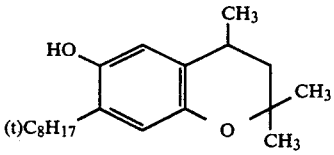
PH-13
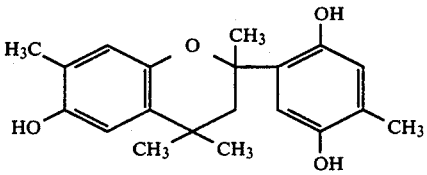
PH-14
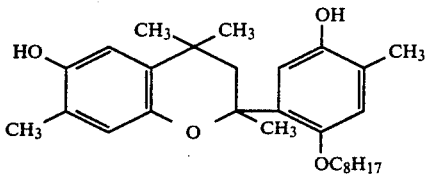
PH-15
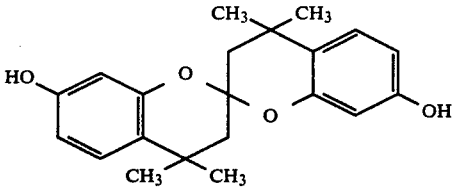
PH-16
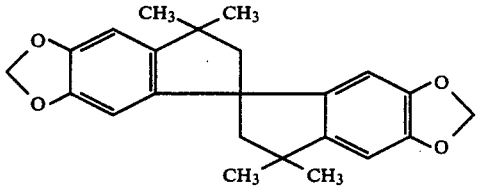
PH-17
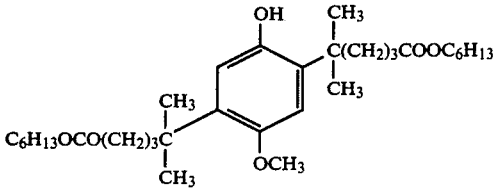

-continued

PH-18

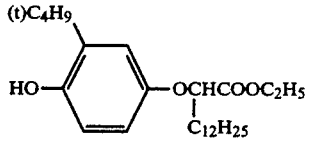

PH-19

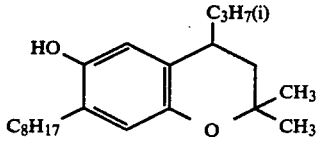

PH-20

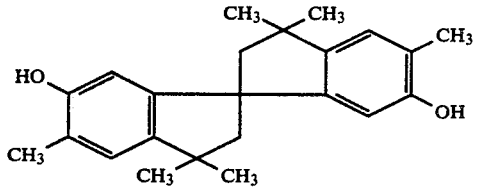

This phenol type compound or phenyl ethyer type compound represented by Formula (II) may be used preferably in the range of $1\times10^{-2}$ mol to 5 mols, more preferably $1\times10^{-1}$ mol to 2 mols, per mol of the magenta coupler of the present invention.

In the present invention, a compound represented by Formula (S) shown below may be preferably be used for the purpose of maintaining the effect of the present invention, i.e., the effect of improving the rapid processing feasibility, color reproducibility and light-fastness and also for the purpose of suppressing the minimum density of a dye image to a lower level.

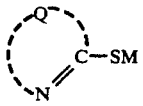

In the formula, Q represents a group of atoms necessary for the formation of a 5- or 6-membered heterocyclic ring that may be condensed with a benzene ring; and M represents a hydrogen atom, an alkali metal atom or an ammonium group.

The heterocyclic ring formed by Q and that may be condensed with a benzene ring may include the rings such as imidazole, tetrazole, thiazole, oxazole, selenazole, benzimidazole, naphthimidazole, benzothiazole, naphtothiazole, benzoselenazole, naphthoselenazole, benzoxazole, pyridine, pyrimidine and quinoline, and these heterocyclic rings include those having a substituent.

Typical examples of the compound represented by Formula (S) are shown below.

S-1

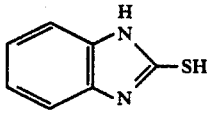

S-2

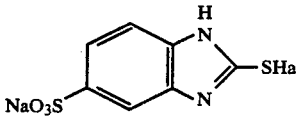

-continued

S-3

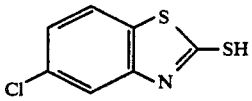

S-4

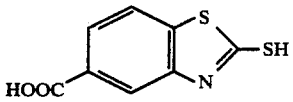

S-5

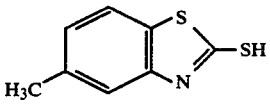

S-6

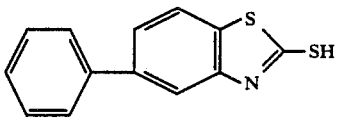

S-7

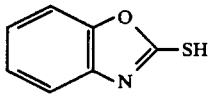

S-8

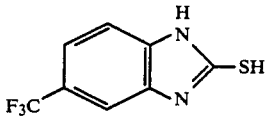

S-9

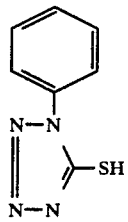

S-10

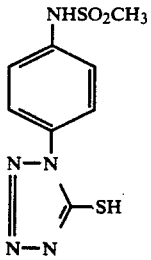

S-11

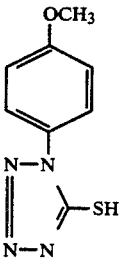

-continued

S-12

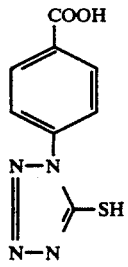

S-13

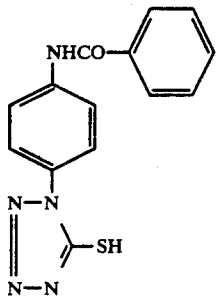

S-14

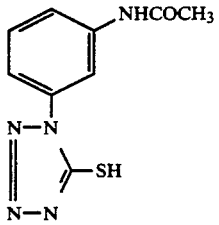

S-15

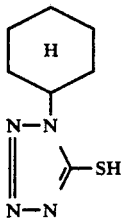

S-16

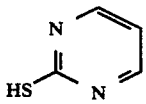

S-17

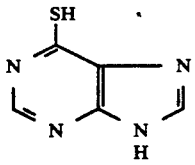

S-18

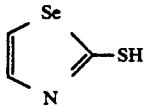

S-19

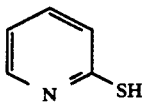

-continued

S-20

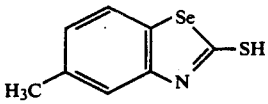

As for the time at which the compound (S) is to be added, the compound may preferably be added in the course of the chemical ripening, at the time of the completion of the chemical ripening, or in the time of after the completion of the chemical ripening and before the coating. The compound may be added in one time in its whole amount, or may be added in plural portions.

The compound (S) may be used usually in the range of $1\times10^{-6}$ to $1\times10^{-1}$ mol, preferably $1\times10^{-5}$ to $1\times10^{-2}$ mol, per mol of silver halide.

A fast-reactive yellow coupler preferably used in the present invention is a yellow coupler having a relative coupling reaction rate of 0.5 or more.

The coupling reaction rate of a coupler can be determined as a relative value by measuring the amount of respective dyes in a color image which is obtained by mixing two types of couplers M and N capable of giving mutually distinctively separable different dyes, adding them in a silver halide emulsion, and then carrying out color development. This method is described in Japanese Patent O.P.I. Publication No. 178954/1987 and No. 178252/1987, Japanese Patent Applications No. 97513/1986, No. 97154/1986 and No. 135150/1986 (unpublished), etc.

In the present invention, it refers to the coupling activity ratio (RM/RN) established when the coupler shown below is used as the above coupler N.

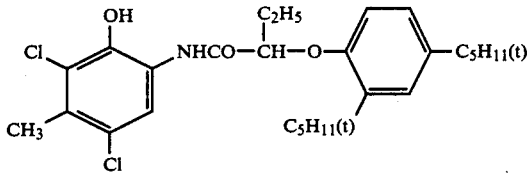

Typical examples of the fast-reactive yellow coupler are shown below.

| Comp. | R | RM/RN |
|---|---|---|
| | 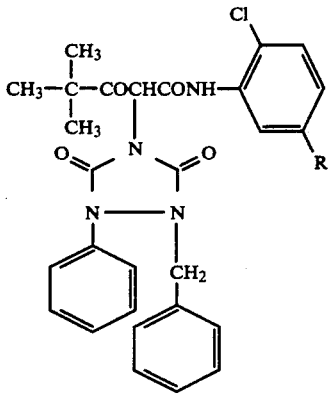 | |

-continued
| Comp. | R | RM/RN |
|---|---|---|
| Y-1 | 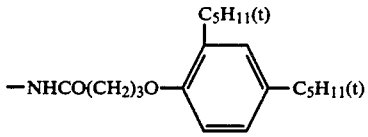 | 0.80 |
| Y-2 | 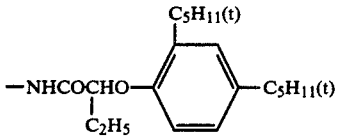 | 0.84 |
| Y-3 | $-SO_2NHC_{12}H_{25}(n)$ | 1.01 |
| Y-4 | $-COOCH(CH_3)COOC_{12}H_{25}(n)$ | 1.45 |
| Y-5 | 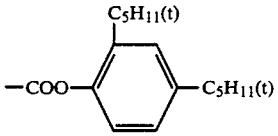 | 1.03 |
| Y-6 | $-NHCO(CH_3)CHCH_2SO_2C_{12}H_{25}$ | 0.95 |
| Y-7 | 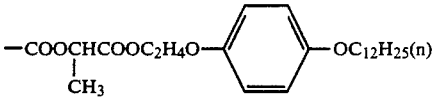 | 1.28 |
| Y-11 | $-COOC_{12}H_{25}(n)$ | 1.32 |
| Y-13 | $-COOCH(C_4H_9(i))COOC_{12}H_{25}(n)$ | 1.48 |
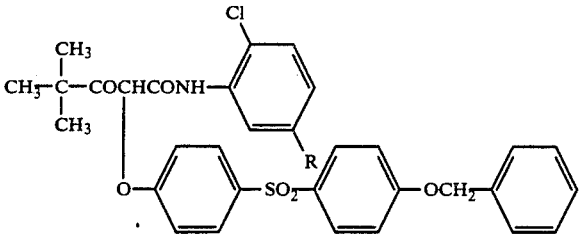
-continued
| Comp. | R | RM/RN |
|---|---|---|
| Y-8 | 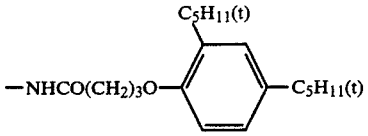 | 0.65 |
| Y-9 | 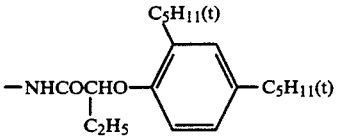 | 0.92 |
| | 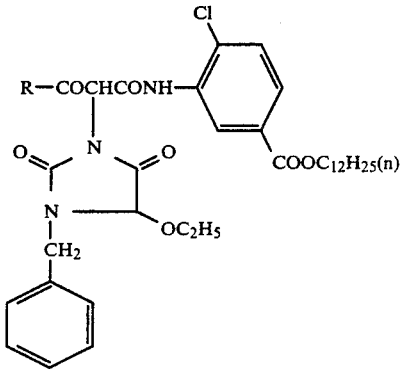 | |
| Y-10 | 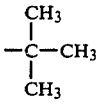 | 1.48 |
| Y-12 | 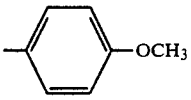 | 1.46 |
(Y-14)
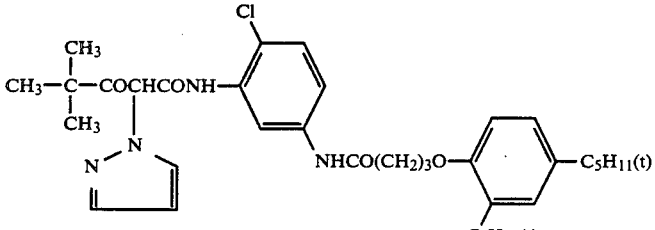
(RM/RN = 1.1)

-continued (Y-15)

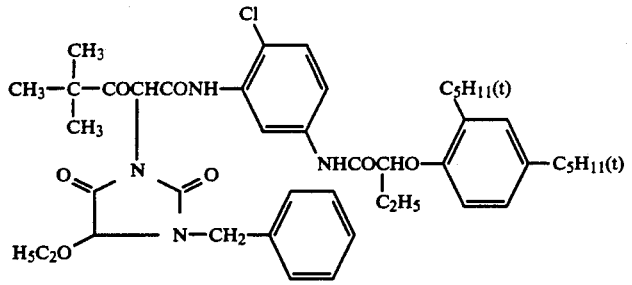

(RM/RN = 0.94)

The yellow coupler may preferably be added in an amount of from $2\times10^{-3}$ to $5\times10^{-1}$ mole, more preferably from $1\times10^{-2}$ to $5\times10^{-1}$ mol, per mol of silver.

The above-described magenta coupler of the present invention may be added in an intended hydrophilic colloid layer after it is dissolved in a high boiling organic solvent boiling at about 150° C. or more, optionally with use of a low-boiling and/or water-soluble organic solvent in combination, and dispersed by emulsification in a hydrophilic binder such as an aqueous gelatin solution with use of a surface active agent.

For the above high-boiling organic solvent, there may preferably be used a compound having a dielectric constant of 7.0 or less, preferably 2.0 or more at the minimum, at 30° C. The compound having a dielectric constant of 7.0 or less may include esters such as phthalate and phosphate, organic amides, ketones, hydrocarbon compounds, etc.

The high boiling solvent preferably used may include dibutyl phthalate, dihexyl phthalate, di-2-ethyl-hexyl phthalate, dioctyl phthalate, dinonyl phthalate, didodecyl phthalate, di-i-octadecyl phthalate, tricrezyl phthalate, trioctyl phthalate, tri-i-nonyl phthalate, tri-i-dodecyl phthalate, etc.

There is no particular limitation in a cyan coupler to be used together with the magenta coupler of the present invention and the fast-reactive yellow coupler, but there can be preferably used the 2,5-diacylaminophenol type cyan couplers described in Japanese Patent O.P.I. Publications No. 112038/1975, No. 109636/1978, No. 163537/1980, No. 31935/1980, No. 100440/1984, No. 121332/1984, No. 124341/1984, No. 139352/1984, No. 146050/1984 and No. 166956/1984, U.S. Pat. No. 2,895,826, etc., and 2-acylaminophenol type cyan couplers described in Japanese Patent O.P.I. Publications No. 117249/1985, No. 205447/1985, No. 3142/1986, No. 9652/1986, No. 9653/1986, No. 27540/1986, No. 39045/1986, No. 50136/1986 and No. 105545/1986, U.S. Pat. No. 3,772,002, etc.

These cyan couplers may be used either alone or in combination, and can be used usually in the range of $1\times10^{-3}$ to 1 mole, preferably $1\times10^{-2}$ to $8\times10^{-1}$ mole, per mol of silver.

The silver halide emulsion layer containing the magenta coupler of the present invention contains silver halide grains containing 80 mol % or more of silver chloride.

The silver halide grains of the present invention contain 80 mol % or more of silver chloride, and may preferably have a silver chloride content of 90 mol % or more. The content of silver bromide may preferably be 10 mol % or less; and the content of silver iodide, 0.5 mol % or less. More preferably, the content of silver chloride may be 95 mol % or more.

The silver halide grains of the present invention may be used alone or may be used by mixing them with other silver halide grains of different composition. They may be also used by mixing them with silver halide grains having a silver chloride content of 10 mol % or less.

In the silver halide emulsion layer containing the silver halide grains of the present invention, having a silver chloride content of 80 mol % or more, the proportion of the silver halide grains having a silver halide content of 80 mol % or more may account for 60 % by weight or more, preferably 80 % by weight or more, of the total silver halide grains contained in said emulsion layer.

The silver halide grains of the present invention may have the composition that is uniform from the inside to outside of a grain, or that is different between the inside and outside of a grain. In the instance in which the composition is different between the inside and outside of a grain, the composition may vary either continuously or discontinuously.

There is no particular limitation in the grain size of the silver halide grains of the present invention, but it may preferably be in the range of 0.2 to 1 6 μm, more preferably 0.25 to 1.2 μm, taking account of other photographic performances such as rapid processability and sensitivity.

The silver halide grains used in the emulsion of the present invention may preferably be the grains such that a latent image is formed chiefly on the surface.

The emulsion of the present invention is chemically sensitized according to a conventional method.

The emulsion of the present invention can be spectrally sensitized to a desired wavelength with use of a sensitizing dye.

There is no particular limitation in the silver halide grains to be used in the emulsion layer(s) other than the above silver halide emulsion layer according to the present invention, but such silver halide grains may preferably have a silver chloride content of 80 mol % or more in the same manner as used in the silver halide emulsion layer according to the present invention.

The light-sensitive silver halide photographic material constituted as above can be, for example, a color negative film or positive film and a color photographic paper, but the effect of the present invention can be effectively exhibited when it is used as a color photographic paper used for direct view.

In the light sensitive silver halide photographic material of the present invention, there can be optionally used additives such as hardening agents, plasticizers, latex, surface active agents, matting agents, lubricants and antistatic agents.

The light sensitive silver halide photographic material of the present invention can form an image by carrying out the color development processing known in the present industrial field.

A color developing solution may have a pH value of usually 7 or more, most generally about 10 to 13.

The color development may be carried out at a temperature of usually 15° C. or more, and generally in the range of 20° C. to 50° C. For the purpose of the rapid development, it may preferably be carried out at 30° C. or more. The development has been carried out conventionally in 3 minutes to 4 minutes, but, in the present invention aiming at the use in the rapid processing, may preferably be carried out in the range of 20 seconds to 60 seconds, more preferably in the range of 30 seconds to 50 seconds.

The light-sensitive silver halide photographic material of the present invention is subjected to bleaching and fixing after the color development. The bleaching may be carried out simultaneously with the fixing.

After the fixing, washing is carried out usually. In place of the washing, stabilizing may be carried out, or both of them may be combined.

As described in the above, the light-sensitive silver halide photographic material of the present invention was found to have a superior color reproducibility, have been improved simultaneously in both the color-forming performance and light fastness of the magenta dye image to be formed, have a superior rapid processing feasibility, and also suffer less yellowing at the white area.

The present invention will be described below by giving specific working examples.

EXAMPLE 1

A variety of coupler dispersions was prepared according to the process shown below and with the composition as shown in Table 1. The resulting dispersions each were mixed in 500 g of a green-sensitive silver halide emulsion prepared according to the process shown below, and 10 ml of an aqueous 10 % solution of sodium 2,4-dihydroxy-6-chloro-s-triazine was added therein as a hardening agent. The resulting solutions each were coated on a polyethylene-coated paper support, followed by drying to obtain Samples 1 to 13.

Preparation of coupler dispersions

In 100 ml of a mixed solvent comprising 40 g of dioctylphthalate (a high-boiling organic solvent) and 100 ml of ethyl acetate, 40 g each of the couplers as shown in Table 1 was dissolved, and the resulting solution was added in 300 ml of an aqueous 5 % gelatin solution containing sodium dodecylbenzenesulfonate, followed by dispersion with use of an ultrasonic homogenizer to make up the coupler dispersions.

Preparation of silver halide emulsion

EM-1

An aqueous solution of silver nitrate and an aqueous solution of sodium chloride were added and mixed With stirring in an aqueous inert gelatin solution according to a double jet method. Here, the conditions were controlled to keep 60° C., pH=3.0 and pAg=7.8. Further added in the same manner were an aqueous solution of silver nitrate and an aqueous solution of potassium bromide. Next, the desalting was carried out according to a conventional method to obtain EM1. EM-1 was found to be a cubic monodispersed silver chloride emulsion (silver chloride: 99.8%; silver bromide: 0.2%) having an average grain size of 0.5 μm.

EM-2

An aqueous solution of silver nitrate and an aqueous halide solution (an aqueous solution comprising a mixture of potassium bromide with sodium chloride) were added and mixed in an aqueous inert gelatin solution according to a double jet method. Here, the conditions were controlled according to the method described in Japanese Patent O.P.I. Publication No. 46437/1984 so as to keep 60° C., pH=3.0 and pAg=7.8. Subsequently, the desalting was carried out according to a conventional method to obtain EM-2. EM-2 was found to be a tetradecahedral silver chloride emulsion containing 90 mol % of silver bromide, having an average grain size of 0.5 μm.

Next, chemical sensitization was carried out on EM-1 and EM-2 under the conditions shown below to prepare corresponding green-sensitive silver halide emulsions EMB-1 and EMB-2, respectively. Provided that the compound (S) was added at the time the chemical sensitization was completed.

Sulfur sensitizer: Sodium thiosulfate, 2.5 mg/mol AgX
Chloroaurate: $5\times10^{-5}$ mol/mol AgX
Sensitizing dye: D-1, 100 mg/mol AgX
Compound (S): As shown in Table 1, $1.5\times10^{-3}$ mol/mol AgX
Temperature: 60° C.
Time: 60 minutes Sensitizing dye (D-1):

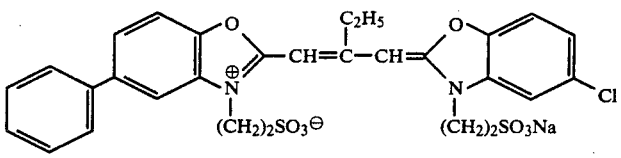

The samples obtained in the above were subjected to wedge exposure according to a conventional method, followed by the processing as shown below.

| Processing steps | Temperature | Time |
|---|---|---|
| Color developing | 34.7 ± 0.3° C. | 50 seconds |
| Bleach-fixing | 34.7 ± 0.5° C. | 50 seconds |
| Stabilizing | 30 to 34° C. | 90 seconds |
| Drying | 60 to 80° C. | 60 seconds |
| (Color developing solution) | | |
| Ethylene glycol | | 10 ml |
| N,N-diethylhydroxylamine | | 10 ml |
| Potassium chloride | | 2 g |
| N-ethyl-β-methanesulfonamidoethyl-3-methyl-4-aminoaniline sulfate | | 5 g |
| Sodium tetrapolyphosphate | | 2 g |
| Potassium carbonate | | 30 g |
| Brightening agent (a 4,4-diaminostilbenedisulfonic acid derivative) | | 1 g |
| Made up to 1 liter in total amount by adding pure water, and adusted to pH 10.08. | | |
| (Bleach-fixing solution) | | |
| Ferric ethylenediaminetetraacetate | | 60 g |

-continued

| | |
|---|---|
| ammonium dihydrate | |
| Ethylenediaminetetraacetic acid | 3 g |
| Ammonium thiosulfate (a 70% solution) | 100 ml |
| Ammonium sulfite (a 40% solution) | 27.5 ml |
| Adjusted to pH 7.1 by use of potassium carbonate or glacial acetic acid, and made up to 1 liter in total amount by adding water. | |
| (Stabilizing solution) | |
| 5-Chloro-2-methyl-4-isothiazolin-3-on | 1 g |
| 1-Hydroxyethylidene-1,1-diphosphonic acid | 2 g |
| Made up to 1 liter by adding water, and adjusted to pH 7.0 by use of sulfuric acid or potassium hydroxide. | |

On the respective samples processed in the above, the color-forming performance, light-fastness, yellowing by light and color reproducibility (secondary absorption density and stain) were measured in the manner shown below. Results obtained are shown together in Table 1.

Color-forming performance

Maximum reflection density (Dmax) of the respective samples were measured, and regarded as a characteristic for "color-forming performance".

Light-fastness

Indicated by the retension of the initial density $D_0=1.0$, observed when sunlight was irradiated on the respective samples for 30 days through an ultraviolet-absorbing filter with use of an underglass outdoor weathering stand.

$$\text{Retension}=D/D_0\times 100\ (\%)$$

wherein D=density after color-fading)

Yellowing by light

Measured was the increased density of the blue-light reflection density ($\Delta D_{min}^{B}$) at unexposed areas (white areas), observed when sunlight was irradiated on the respective samples for 30 days through an ultraviolet-absorbing filter with use of an underglass outdoor weathering stand.

Secondary absorption density

Spectra of spectral reflection of the respective color formed samples were measured by use of a color analyzer Type-607 (available from Hitachi, Ltd.). Here, the maximum density of the absorption spectra at visible areas of the respective samples were measured by standardizing them to 1.0. The reflection density of the respective samples at 430 nm was regarded as the secondary absorption density, and used as an indication for the color purity.

Stain

Measured was the green light reflection density ($D_{min}^{G}$) at unexposed areas of the respective samples immediately after processing.

TABLE 1

| Sample No. | Magenta coupler | Anti-color-fading agent | Emulsion: Silver halide particles | Emulsion: Silver chloride content | Emulsion: Compound [S] | Fastness to light (%) | Color-forming performance (Dmax) | Color reproducibility: Secondary absorption density | Color reproducibility: Stain ($D_{min}^{G}$) | Yellowing by light ($D_{min}^{B}$) |
|---|---|---|---|---|---|---|---|---|---|---|
| 1 (X) | MC-1 | — | EM-2 | 10 | S-14 | 48 | 1.73 | 0.49 | 0.05 | 0.21 |
| 2 (") | " | — | EM-1 | 99.8 | " | 49 | 2.12 | 0.50 | 0.07 | 0.21 |
| 3 (") | M-1 | — | EM-2 | 10 | " | 34 | 1.86 | 0.20 | 0.05 | 0.04 |
| 4 (") | " | — | EM-1 | 99.8 | " | 34 | 2.35 | 0.20 | 0.05 | 0.04 |
| 5 (") | " | Compar.-1 | " | " | " | 45 | 2.26 | 0.20 | 0.06 | 0.05 |
| 6 (") | " | Compar.-2 | " | " | " | 64 | 1.91 | 0.21 | 0.05 | 0.17 |
| 7 (Y) | " | A-3 | " | " | " | 90 | 2.41 | 0.20 | 0.04 | 0.04 |
| 8 (") | " | A-6 | " | " | " | 89 | 2.40 | 0.20 | 0.04 | 0.04 |
| 9 (") | " | A-33 | " | " | " | 89 | 2.42 | 0.20 | 0.04 | 0.04 |
| 10 (") | " | A-34 | " | " | " | 90 | 2.40 | 0.20 | 0.04 | 0.04 |
| 11 (") | " | A-10 | " | " | " | 91 | 2.42 | 0.21 | 0.04 | 0.04 |
| 12 (") | " | A-35 | " | " | " | 84 | 2.39 | 0.21 | 0.04 | 0.04 |
| 13 (") | " | A-10 | " | " | SC-1 | 91 | 2.41 | 0.20 | 0.08 | 0.04 |

X: Comparative example Y: Present invention

*Coated silver amount in Samples 1 and 2: 4 mg/100 $cm^2$; Coated silver amount in Samples 3 to 12: 2 mg/100 $cm^2$.

*Amount of Comparative anti-color-fading agent 1 added: Equimolar to magenta coupler.

*Amount of Comparative anti-color-fading agent 2 added: Hindered amine is equivalent to magenta coupler.

MC-1

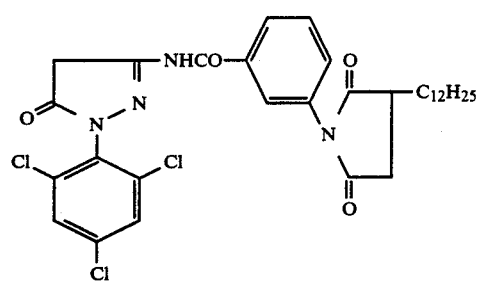

SC-1

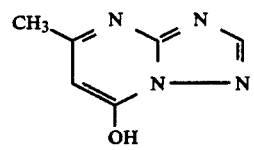

Comparative anti-color-fading agent 1

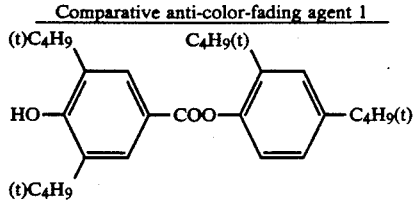

-continued

Comparative anti-color-fading agent 2

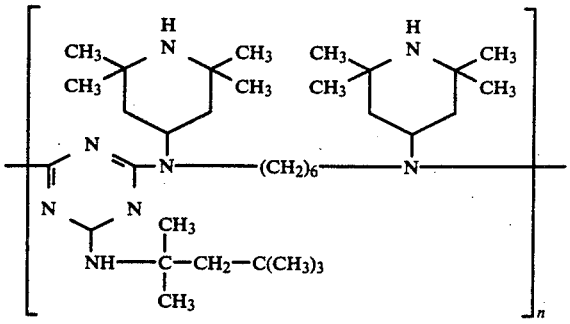

to the stain, thus being desirable for the color reproduction.

Example 2

Preparation of Sample 7 in Example 1 was repeated except that the magenta coupler, the anti-color-fading agent, the high-boiling organic solvent and the silver chloride content in silver halide grains were varied as shown in Table 2, to obtain 18 kinds of samples (Samples 14 to 31).

The same color-forming performance test, color-fastness test and color reproducibility test as those in Example 1 were carried out on these samples. Results obtained are shown in Table 2.

TABLE 2

| Sample No. | Magenta coupler | Anti-color-fading agent | High-boiling organic solvent sion | Emulsion silver chloride content | Fastness to light (%) | Color-forming performance (Dmax) | Color reproducibility: Secondary absorption density | Color reproducibility: Stain ($D_{min}^{G}$) | Yellowing by light ($D_{min}^{B}$) |
|---|---|---|---|---|---|---|---|---|---|
| 14 (X) | MC-1 | — | DOP | 99.8 | 48 | 2.11 | 0.50 | 0.07 | 0.22 |
| 15 (") | M-1 | Compar.-2 | " | " | 64 | 1.85 | 0.20 | 0.05 | 0.04 |
| 16 (") | " | A-10 | " | 10 | 90 | 1.85 | 0.20 | 0.05 | 0.04 |
| 17 (") | " | " | " | 50 | 91 | 1.89 | 0.20 | 0.05 | 0.04 |
| 18 (Y) | " | " | " | 80 | 90 | 2.34 | 0.20 | 0.06 | 0.04 |
| 19 (") | " | " | " | 99.8 | 90 | 2.38 | 0.20 | 0.06 | 0.04 |
| 20 (") | " | " | " | 100 | 91 | 2.39 | 0.22 | 0.25 | 0.04 |
| 21 (") | M-4 | " | " | 99.8 | 90 | 2.37 | 0.20 | 0.05 | 0.04 |
| 22 (") | M-10 | " | " | " | 94 | 2.30 | 0.20 | 0.05 | 0.04 |
| 23 (") | M-22 | " | " | " | 96 | 2.31 | 0.21 | 0.06 | 0.03 |
| 24 (") | M-26 | " | " | " | 96 | 2.28 | 0.21 | 0.05 | 0.03 |
| 25 (") | M-46 | " | " | " | 95 | 2.29 | 0.19 | 0.06 | 0.04 |
| 26 (") | M-11 | " | " | " | 94 | 2.31 | 0.21 | 0.05 | 0.04 |
| 27 (") | " | A-10 × PH-10 | " | " | 96 | 2.36 | 0.20 | 0.06 | 0.04 |
| 28 (") | " | A-10 × PH-15 | DBP | " | 92 | 2.37 | 0.21 | 0.06 | 0.04 |
| 29 (") | " | A-10 | TCP | " | 90 | 2.21 | 0.19 | 0.05 | 0.06 |
| 30 (") | " | " | TNP | " | 90 | 2.19 | 0.20 | 0.05 | 0.04 |
| 31 (") | " | " | DEP | " | 89 | 2.22 | 0.20 | 0.07 | 0.05 |

X: Comparative example Y: Present invention

*Coated silver amount in Sample 14: 4 mg/100 $cm^2$; Coated silver amount in Samples 15 to 31: 2 mg/100 $cm^2$.

*Amount of Comparative anti-color-fading agent 1 added: Equimolar to magenta coupler.

*Comparative anti-color-fading agent 2: Same as in Example 1; Amount thereof: Hindered amine is equivalent to magenta coupler.

*DOP: Dioctyl phthalate; DBP: Dibutyl phthalate; TCP: Tricresyl phosphate; TNP: Trinonyl phosphate; DEP: Diethyl phthalate.

As will be clear from Table 1, Samples 1 and 2 in which the comparative couplers are used show a high secondary density and a cloudy color in magenta images, giving unsharp images. Also, as is seen in Sample 2, the color-forming performance is improved by using silver halide grains having a high silver chloride content even if the comparative coupler is used, but is only improved with insufficiency.

Sample 4 in which the magenta coupler of the present invention and the silver halide grains having a silver chloride content of 99.8 mol % are used, shows good results for both color-forming performance and color reproducibility, but a poor result for light-fastness. Also, Sample 5 in which the comparative anti-color-fading agency is used shows a small effect of improving the light-fastness, and Sample 6 involves the problem of the yellowing by light or the deterioration of color-forming performance. Thus, these can not satisfy all of the performances.

All of the color-forming performance, light-fastness, color reproducibility and resistance to yellowing by light are improved only when the silver halide grains of the present invention, the magenta coupler of the present invention and the anti-color-fading agent of the present invention are used.

Also, Samples 7 to 12 in Which the compound S-14 is used show better light fastness than Sample 13 in Which the compound SC-1 is used, and smaller values also as As will be clear from Table 2, in all of the samples of the present invention, there can be obtained sharp magenta color images having an excellent light-fastness and color forming performance, and also less yellowing by light and a small secondary absorption density (i.e., less color-cloudiness).

The color-forming performance also is improved with more preferable results when the silver chloride content in the silver halide grains is not less than 90 mol % and not more than 99.9.mol %.

The light-fastness also is further improved in Samples 22, 23 and 24 in which the magenta coupler substituted at the 6-position with an isopropyl group or a t-butyl group is used.

Example 3

Respective layers of the composition shown below were provided by coating in sequence from the support side, on supports comprising polyethylene-coated paper to prepare color light sensitive materials for multicolor photography. The amount of compounds is indicated by the amount per 100 $cm^2$.

First layer: Blue-sensitive silver chloride emulsion layer

Yellow coupler (*), 8 mg; blue-sensitive silver chloride emulsion (Em-A) shown below, 3 mg in terms of silver; high-boiling organic solvent (DNP), 3 mg; and gelatin, 16 mg.

Second layer: Intermediate layer

A hydroquinone derivative (HQ-1), 0.45 mg; and gelatin, 4 mg.

Third layer: Green-sensitive silver chloride emulsion layer

Magenta coupler (*), 4 mg; green-sensitive silver chloride emulsion (Em-B, -C or -D) shown below, 2 mg (B, D) or 4 mg (C) in terms of silver; high-boiling organic solvent (DOP), 4 mg; anti-color-fading agent (*), in an amount equimolar to magenta coupler; and gelatin, 16 mg.

Fourth layer: Intermediate layer

Ultraviolet absorbent (UV-1), 3 mg; Ultraviolet absorbent (UV-2), 3 mg; DNP, 4 mg; HQ-1, 0.45 g; and gelatin, 14 mg.

Fifth layer: Red-sensitive silver chloride emulsion layer

Cyan coupler (*), 4 mg; DOP, 4 mg; red-sensitive silver chloride emulsion (Em-E) shown below, 3 mg in terms of silver; and gelatin, 14 mg.

Sixth layer: Intermediate layer

UV-1, 2 mg; UV-2, 2 mg; DNP, 2 mg; and gelatin, 6 mg.

Seventh layer: Protective layer

Gelatin, 9 mg.

The symbol (*) in the first to seventh layers is meant as shown in Table 3. Silver halide emulsions Em-A to Em-E used are as follows:

| Layer | Name | Proportion of silver chloride (mol %) | Particle size (μm) | Compound [S] |
|---|---|---|---|---|
| First | Em-A | 99.8 | 0.8 | S-14 |
| Third | Em-B | 99.8 | 0.4 | S-14 |
| " | Em-C | 20 | 0.4 | S-14 |
| " | Em-D | 99.8 | 0.4 | S-1 |
| Fifth | Em-E | 99.8 | 0.4 | S-14 |

D-1 (same as in Example 1) was used as the sensitizing dye for Em-B, Em-C and Em-D; D-2, for Em-A; and D-3, for Em-E.

These samples were subjected to wedge exposure by white light with use of a sensitometer (produced by Konishiroku Photo Industry Co., Ltd.; KS-7 Type), followed by the same processing as in Example 1.

On the samples thus obtained, the same tests as those shown in Example 1 were carried out.

Results obtained are shown in Table 3.

D-2

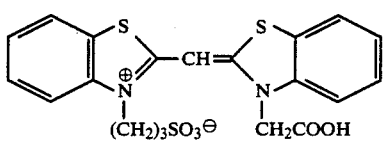

D-3

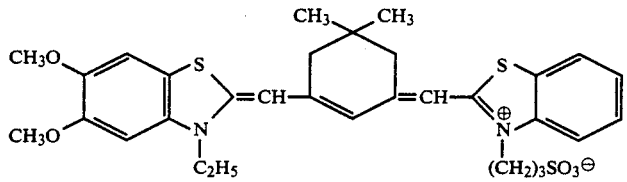

UV-1

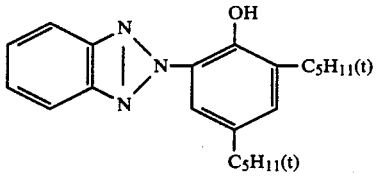

UV-2

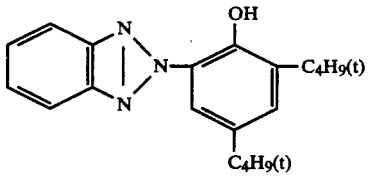

YC-1

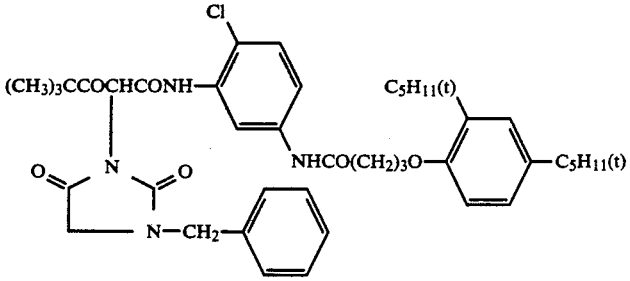

-continued
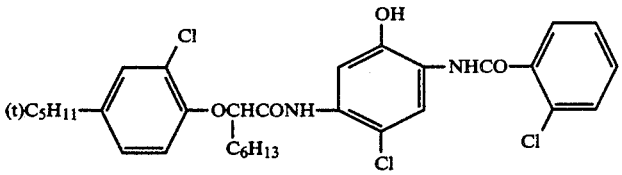
CC-1
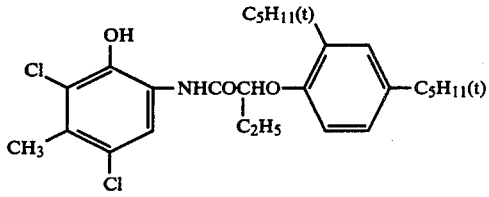
CC-2
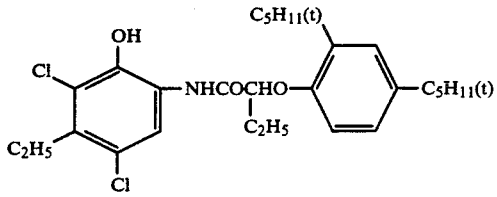
CC-3
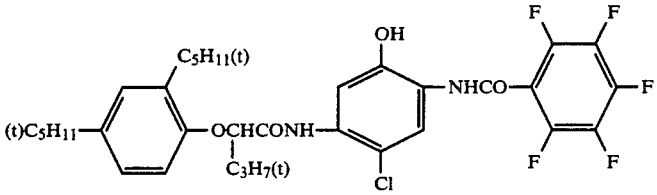
CC-4
Metal Complex 1
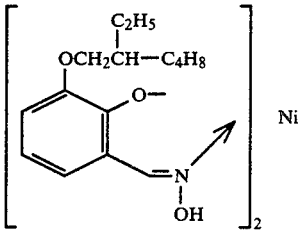
Metal Complex 2
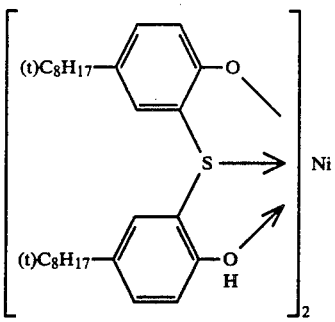
TABLE 3
| Sample | Couplers | | | Third Layer | | Light fastness (%) | | |
|---|---|---|---|---|---|---|---|---|
| No. | Y | M | C | Emulsion | Anti-color-fading agent | Y | M | C |
| 32 (X) | YC-1 | MC-1 | CC-2 | Em-C | — | 87 | 60 | 90 |
| 33 (") | Y-16 | M-10 | " | Em-D | — | 84 | 27 | 91 |
| 34 (") | " | " | " | " | Comparative agent 2 | 85 | 49 | 92 |
| 35 (Y) | " | " | " | " | A-10 | 84 | 73 | 92 |
| 36 (") | " | " | " | Em-B | " | 85 | 74 | 91 |
| 37 (") | " | " | CC-2 + CC-4 | " | " | 85 | 74 | 86 |
| 38 (") | " | " | " | " | A-10 + PH-10 | 85 | 87 | 87 |
| 39 (") | " | " | " | " | A-10 + PH-15 | 84 | 86 | 86 |
| 40 (") | " | " | " | " | A-10 + Metal complex 1 | 84 | 88 | 86 |
| 41 (") | " | " | " | " | A-10 + Metal complex 2 | 84 | 88 | 87 |

TABLE 3-continued

| | | | | | | | | |
|---|---|---|---|---|---|---|---|---|
| 42 (") | " | M-26 | " | " | A-10 + PH-15 | 84 | 89 | 86 |
| 43 (") | " | M-46 | CC-1 + CC-3 | " | A-10 + PH-10 | 83 | 88 | 85 |
| 44 (") | " | M-48 | " | " | " | 83 | 89 | 86 |
| 45 (") | " | M-50 | " | " | " | 84 | 90 | 87 |

| Sample No. | Color-forming performance (Dmax) Y | M | C | Color reproducibility: Secondary absorption density | Stain ($D_{min}^{G}$) | Yellowing by light ($D_{min}^{B}$) |
|---|---|---|---|---|---|---|
| 32 (X) | 2.05 | 1.81 | 2.38 | 0.52 | 0.05 | 0.22 |
| 33 (") | 2.34 | 2.25 | 2.37 | 0.21 | 0.07 | 0.05 |
| 34 (") | 2.33 | 1.99 | 2.39 | 0.22 | 0.06 | 0.18 |
| 35 (Y) | 2.33 | 2.34 | 2.39 | 0.20 | 0.07 | 0.05 |
| 36 (") | 2.35 | 2.33 | 2.40 | 0.20 | 0.05 | 0.05 |
| 37 (") | 2.34 | 2.36 | 2.32 | 0.21 | 0.05 | 0.05 |
| 38 (") | 2.33 | 2.34 | 2.31 | 0.20 | 0.04 | 0.05 |
| 39 (") | 2.36 | 2.39 | 2.31 | 0.20 | 0.05 | 0.05 |
| 40 (") | 2.34 | 2.31 | 2.32 | 0.21 | 0.05 | 0.06 |
| 41 (") | 2.35 | 2.30 | 2.31 | 0.21 | 0.05 | 0.07 |
| 42 (") | 2.36 | 2.31 | 2.32 | 0.20 | 0.05 | 0.05 |
| 43 (") | 2.33 | 2.39 | 2.32 | 0.20 | 0.05 | 0.05 |
| 44 (") | 2.34 | 2.34 | 2.36 | 0.21 | 0.05 | 0.05 |
| 45 (") | 2.35 | 2.32 | 2.36 | 0.20 | 0.05 | 0.05 |

X: Comparative example Y: Present invention

*Samples 37 to 42: CC-2 was coated so as to be in an amount of 1 mg/100 $cm^2$; and CC-4, 3 mg/100 $cm^2$.

*Samples 43 to 45: Both CC-1 and CC-3 were coated so as to be in an amount of 2 mg/100 $cm^2$.

*Amount of the anti-color-fading agent added: Equimolar to magenta coupler, provided that the metal complex was in 0.2 molar amount.

As will be clear from Table 3, the samples of the present invention show good results for all the light-fastness, color-forming performance, and color reproducibility of resistance to yellowing by light, of magenta dye images. There is also attained a good color-fading balance or color-forming balance between the yellow, magenta and cyan images, thus obtaining sharp images.

In contrast thereto, in Sample 34 in which the comparative anti-color-fading agent is used, the color-forming performance is deteriorated or the yellowing by light is increased although the light-fastness of the magenta image is improved. There is also attained only a poor color-forming balance between the yellow, magenta and cyan images, resulting in the reproduction of a neutral image in a greenish color.

Also, when the phenol type antioxidants or the metal complexes are used as the anti-color-fading agent in combination with the compound of the present invention, the light-fastness of the magenta image is improved and the color-fading by light is well-balanced, thus obtaining favorable results.

EXAMPLE 4

A variety of coupler dispersions was prepared according to the process shown below and with the composition as shown in Table 4. The resulting dispersions each were mixed in 500 g of a green-sensitive silver halide emulsion prepared according to the process shown below, and 10 ml of an aqueous 10% solution of sodium 2,4-dihydroxy-6-chloro-s-triazine was added therein as a hardening agent. The resulting solutions each were coated on a polyethylene-coated paper support, followed by drying to obtain Samples 1 to 13.

Preparation of coupler dispersions

In 100 ml of a mixed solvent comprising 40 g of dioctylphthalate (a high-boiling organic solvent) and 100 ml of ethyl acetate, 40 g each of the couplers as shown in Table 1 was dissolved, and the resulting solution was added in 300 ml of an aqueous 5% gelatin solution containing sodium dodecylbenzenesulfonate, followed by dispersion with use of an ultrasonic homogenizer to make up the coupler dispersions.

Preparation of silver halide emulsion

EM-1

An aqueous solution of silver nitrate and an aqueous solution of sodium chloride were added and mixed with stirring in an aqueous inert gelatin solution according to a double jet method. Here, the conditions were controlled to keep 60° C., pH=3.0 and pAg=7.8. Further added in the same manner were an aqueous solution of silver nitrate and an aqueous solution of potassium bromide. Next, the desalting was carried out according to a conventional method to obtain EM-1. EM-1 was found to be a cubic monodispersed silver chloride emulsion (silver chloride: 99.8%; silver bromide: 0.2%) having an average grain size of 0.5 μm.

An aqueous solution of silver nitrate and an aqueous of halides (an aqueous solution comprising a mixture of potassium bromide with sodium chloride) were added and mixed in an aqueous inert gelatin solution according to a double jet method. Here, the conditions were controlled according to the method described in Japanese Patent O.P.I. Publication No. 45437/1984 so as to keep 60° C., pH=3.0 and pAg=7.8. Subsequently, the desalting was carried out according to a conventional method to obtain EM-2. EM-2 was found to be a tetadecahedral silver chloride emulsion containing 90 mol % of silver bromide, having an average grain size of 0.5 μm.

Next, chemical sensitization was carried out on EM-1 and EM-2 under the conditions shown below to prepare corresponding green-sensitive silver halide emulsions EMB-1 and EMB-2, respectively. Provided that the compounds (S) was added at the time the chemical sensitization was completed.

Sulfur sensitizer: Sodium thiosulfate, 2.5 mg/mol AgX

Chloroaurate: $5\times10^{-5}$ mol/mol AgX

Sensitizing dye: D-1, 100 mg/mol AgX

Compound (S): As shown in Table 1, $1.5\times10^{-3}$ mol/mol AgX

Temperature: 60° C.

Time: 60 minutes

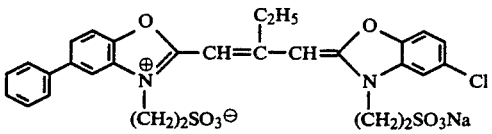

The samples obtained in the above were subjected to wedge exposure according to a conventional method, followed by the processing as shown below.

| Processing steps | Temperature | Time |
|---|---|---|
| Color developing | 34.7 ± 0.3° C. | 50 seconds |
| Bleach-fixing | 34.7 ± 0.5° C. | 50 seconds |
| Stabilizing | 30 to 34° C. | 90 seconds |
| Drying | 60 to 80° C. | 60 seconds |
| (Color developing solution) | | |
| Ethylene glycol | | 10 ml |
| N,N-diethylhydroxylamine | | 10 ml |
| Potassium chloride | | 2 g |
| N-ethyl-β-methanesulfonamidoethyl-3-methyl-4-aminoaniline sulfate | | 5 g |
| Sodium tetrapolyphosphate | | 2 g |
| Potassium carbonate | | 30 g |
| Brightening agent (a 4,4-diaminostilbenedisulfonic acid derivative) | | 1 g |
| Made up to 1 liter in total amount by adding pure water, and adjusted to pH 10.08. | | |
| (Bleach-fixing solution) | | |
| Ferric ethylenediaminetetraacetate ammonium dihydrate | | 60 g |
| Ethylenediaminetetraacetic acid | | 3 g |
| Ammonium thiosulfate (a 70% solution) | | 100 ml |
| Ammonium sulfite (a 40% solution) | | 27.5 ml |
| Adjusted to pH 7.1 by use of potassium carbonate or glacial acetic acid, and made up to 1 liter in total amount by adding water. | | |
| (Stabilizing solution) | | |
| 5-Chloro-2-methyl-4-isothiazolin-3-on | | 1 g |
| 1-Hydroxyethylidene-1,1-diphosphonic acid | | 2 g |
| Made up to 1 liter by adding water, and adjusted to pH 7.0 by use of sulfuric acid or potassium hydroxide. | | |

On the respective samples processed in the above, the color-forming performance, light-fastness, yellowing by light and color reproducibility (secondary absorption density and stain) were measured in the manner shown below. Results obtained are shown together in Table 1.

Color-forming performance

Maximum reflection density (Dmax) of the respective samples were measured, and regarded as a characteristic for "color-forming performance".

Light-fastness

Indicated by the retension of the initial density $D_0=1.0$, observed when sunlight was irradiated on the respective samples for 30 days through an ultraviolet-absorbing filter with use of an underglass outdoor weathering stand.

$$\text{Retension} = D/D_0 \times 100\ (\%)$$

Secondary absorption density

Spectra of spectral reflection of the respective color-formed samples were measured by use of a color analyzer Type-607 (available from Hitachi, Ltd.). Here, the maximum density of the absorption spectra at visible areas of the respective samples were measured by standardizing them to 1.0. The reflection density of the respective samples at 430 nm was regarded as the secondary absorption density, and used as an indication for the color purity.

Stain

Measured was the reflection density (Dmin) at unexposed areas of the respective samples immediately after processing.

TABLE 4

| Sample No. | Magenta coupler | Anti-color-fading agent | Emulsion: Silver halide particles | Emulsion: Silver chloride content | Emulsion: Compound [S] | Fastness to light (%) | Color-forming performance (Dmax) | Color reproducibility: Secondary absorption density | Color reproducibility: Stain (Dmin) |
|---|---|---|---|---|---|---|---|---|---|
| 1 (X) | MC-1 | — | EM-2 | 10 | S-14 | 48 | 1.73 | 0.49 | 0.05 |
| 2 (") | " | — | EM-1 | 99.8 | " | 49 | 2.12 | 0.50 | 0.07 |
| 3 (") | M-1 | — | EM-2 | 10 | " | 34 | 1.86 | 0.20 | 0.05 |
| 4 (") | " | — | EM-1 | 99.8 | " | 34 | 2.35 | 0.20 | 0.05 |
| 5 (") | " | Compar.-1 | " | " | " | 45 | 2.26 | 0.20 | 0.06 |
| 6 (") | " | Compar.-2 | " | " | " | 86 | 1.83 | 0.21 | 0.05 |
| 7 (Y) | " | B-1 | " | " | " | 89 | 2.37 | 0.20 | 0.04 |
| 8 (") | " | B-3 | " | " | " | 88 | 2.34 | 0.20 | 0.04 |
| 9 (") | " | B-4 | " | " | " | 89 | 2.35 | 0.20 | 0.04 |
| 10 (") | " | B-6 | " | " | " | 87 | 2.37 | 0.20 | 0.04 |
| 11 (") | " | B-12 | " | " | " | 85 | 2.33 | 0.21 | 0.04 |
| 12 (") | " | B-13 | " | " | " | 83 | 2.39 | 0.21 | 0.04 |
| 13 (") | " | B-3 | " | " | SC-1 | 79 | 2.35 | 0.20 | 0.11 |

X: Comparative example Y: Present invention

*Coated silver amount in Samples 1 and 2: 4 mg/100 cm$^2$; Coated silver amount in Samples 3 to 12: 2 mg/100 cm$^2$.

*Amounts of the anti-color-fading agents added: All equimolar to magenta coupler.

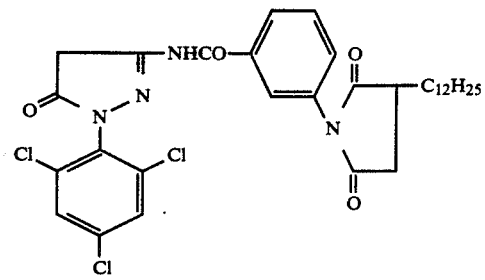

MC-1

-continued

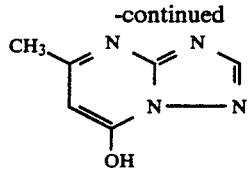

SC-1

Comparative anti-color-fading agent 1

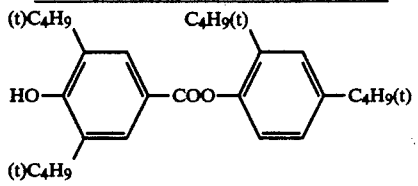

Comparative anti-color-fading agent 2

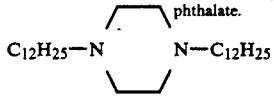

As will be clear from Table 4, Samples 1 and 2 in which the comparative couplers are used show a high secondary density and a cloudy color in magenta images, giving unsharp images. Also, in Sample 2 in which the silver halide grains having a high silver chloride content, the color-forming performance is improved, but only with insufficiency. Sample 4 in which the magenta coupler of the present invention and the silver halide grains having a silver chloride content of 99.8 mol % are used, shows good results for both color-forming performance and color reproducibility, but a poor result for light-fastness. Also, Sample 5 in which the comparative anti-color-fading agent is used shows a small effect of improving the light-fastness, and Sample 6 involves the problem the problem that the color-forming performance is deteriorated. Thus, these can not satisfy all of the performances.

All of the color-forming performance, light-fastness and color reproducibility are improved only when the silver halide grains of the present invention, the magenta coupler of the present invention and the anti-color-fading agent of the present invention are used.

Also, Samples 7 to 12 in which the compound S-14 is used show better light-fastness than Sample 13 in which the compound SC-1 is used, and smaller values also as to the stain, thus being desirable for the color reproduction.

EXAMPLE 5

Preparation of Sample 7 in Example 4 was repeated except that the magenta coupler, the anti-color-fading agent, the high-boiling organic solvent and the silver chloride content in silver halide grains were varied as shown in Table 2, to obtain 18 kinds of samples (Samples 14 to 31).

The color-forming performance test, color-fastness test and color reproducibility test same as those in Example 4 were carried out on these samples. Results obtained are shown in Table 5.

TABLE 5

| Sample No. | Magenta coupler | Anti-color-fading agent | High-boiling organic solvent (Dielectric constant) | Emulsion silver chloride content | Fastness to light (%) | Color-forming performance (Dmax) | Color reproducibility: Secondary absorption density | Color reproducibility: Stain (Dmin) |
|---|---|---|---|---|---|---|---|---|
| 14 (X) | MC-1 | — | DOP (5.3) | 99.8 | 48 | 2.11 | 0.50 | 0.07 |
| 15 (") | M-1 | Compar.-2 | " | " | 87 | 1.84 | 0.20 | 0.05 |
| 16 (") | " | B-1 | " | 10 | 87 | 1.86 | 0.20 | 0.05 |
| 17 (") | " | " | " | 50 | 88 | 1.89 | 0.20 | 0.05 |
| 18 (Y) | " | " | " | 80 | 89 | 2.34 | 0.20 | 0.06 |
| 19 (") | " | " | " | 99.8 | 89 | 2.35 | 0.20 | 0.06 |
| 20 (") | " | " | " | 100 | 89 | 2.36 | 0.22 | 0.25 |
| 21 (") | M-4 | " | " | 99.8 | 88 | 2.36 | 0.20 | 0.05 |
| 22 (") | M-10 | " | " | " | 92 | 2.28 | 0.20 | 0.05 |
| 23 (") | M-22 | " | " | " | 95 | 2.28 | 0.21 | 0.06 |
| 24 (") | M-26 | " | " | " | 95 | 2.27 | 0.21 | 0.05 |
| 25 (") | M-46 | " | " | " | 93 | 2.39 | 0.19 | 0.06 |
| 26 (") | M-11 | " | " | " | 93 | 2.33 | 0.21 | 0.05 |
| 27 (") | " | B-1 + PH-10 | " | " | 94 | 2.38 | 0.20 | 0.06 |
| 28 (") | " | B-1 + PH-15 | DBP (6.4) | " | 90 | 2.41 | 0.21 | 0.06 |
| 29 (") | " | B-1 | TCP (6.9) | " | 89 | 2.25 | 0.19 | 0.05 |
| 30 (") | " | " | TNP (4.5) | " | 86 | 2.18 | 0.20 | 0.05 |
| 31 (") | " | " | DEP (7.6) | " | 82 | 2.15 | 0.20 | 0.07 |

X: Comparative example Y: Present invention

*Coated silver amount in Sample 14: 4 mg/100 $cm^2$; Coated silver amount in Samples 15 to 31: 2 mg/100 $cm^2$.

*Amounts of the anti-color-fading agents added: All equimolar to magenta coupler.

*Comparative anti-color-fading agent 2: Same as in Example 1.

*DOP: Dioctyl phthalate; DBP: Dibutyl phthalate; TCP: Tricresyl phosphate; TNP: Trinonyl phosphate; DEP: Diethyl phthalate.

As will be clear from Table 5, in all of the samples of the present invention, there can be obtained sharp magenta color images having an excellent light-fastness and color-forming performance, and also a small secondary absorption density (i.e., less color-cloudiness).

The color-forming performance also is improved with more preferable results when the silver chloride content in the silver halide grains is not less than 90 mol % and not more than 99.9 mol %.

The light-fastness also is further improved in Samples 22, 23 and 24 in which the magenta coupler substituted at the 6-position with an isopropyl group or a t-butyl group.

Also, in the samples in which the high-boiling organic solvent having a dielectric constant of 7.0 or less is used, the light-fastness and color-forming performance are seen to be improved.

EXAMPLE 6

Respective layers of the composition shown below were provided by coating in sequence from the support side, on supports comprising polyethylene-coated paper to prepare color light-sensitive materials for multicolor photography. The amount of compounds is indicated by the amount per 100 $cm^2$.

First layer: Blue-sensitive silver chloride emulsion layer

Yellow coupler (*), 8 mg; blue-sensitive silver chloride emulsion (Em-A) shown below, 3 mg in terms of silver; high-boiling organic solvent (DNP), 3 mg; and gelatin, 16 mg.

Second layer: Intermediate layer

A hydroquinone derivative (HQ-1), 0.45 mg; and gelatin, 4 mg.

Third layer: Green-sensitive silver chloride emulsion layer

Magenta coupler (*), 4 mg; green-sensitive silver chloride emulsion (Em-B, -C or -D) shown below, 2 mg (B, D) or 4 mg (C) in terms of silver; high-boiling organic solvent (DOP), 4 mg; anti-color-fading agent (*), in an amount equimolar to magenta coupler; and gelatin, 16 mg.

Fourth layer: Intermediate layer

Ultraviolet absorbent (UV-1), 3 mg; Ultraviolet absorbent (UV-2), 3 mg; DNP, 4 mg; HQ-1, 0.45 g; and gelatin, 14 mg.

Fifth layer: Red-sensitive silver chloride emulsion layer

Cyan coupler (*), 4 mg; DOP, 4 mg; red-sensitive silver chloride emulsion (Em-E) shown below, 3 mg in terms of silver; and gelatin, 14 mg.

Sixth layer: Intermediate layer

UV-1, 2 mg; UV-2, 2 mg; DNP, 2 mg; and gelatin, 6 mg.

Seventh layer: Protective layer Gelatin, 9 mg.

The symbol (*) in the first to seventh layers is meant as shown in Table 6. Silver halide emulsions Em-A to Em-E used are as follows:

| Layer | Name | Proportion of silver chloride (mol %) | Particle size (μm) | Compound [S] |
|---|---|---|---|---|
| First | Em-A | 99.8 | 0.8 | S-14 |
| Third | Em-B | 99.8 | 0.4 | S-14 |
| " | Em-C | 20 | 0.4 | S-14 |
| " | Em-D | 99.8 | 0.4 | S-1 |
| Fifth | Em-E | 99.8 | 0.4 | S-14 |

D-1 (same as in Example 1) was used as the sensitizing dye for Em-B, Em-C and Em-D; D-2, for Em-A; and D-3, for Em-E.

These samples were subjected to wedge exposure by white light with use of a sensitometer (produced by Konishiroku Photo Industry Co., Ltd.; KS-7 Type), followed by the same processing as in Example 4.

On the samples thus obtained, the same tests as those in Example 1 were carried out.

Results obtained are shown in Table 6.

D-2

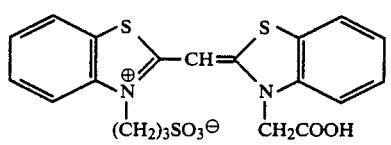

D-3

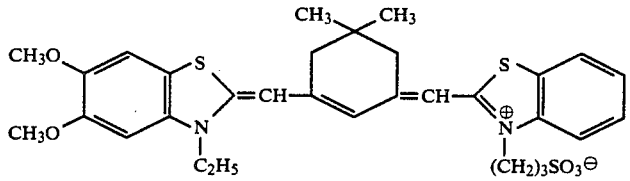

UV-1

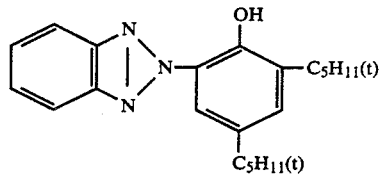

UV-2

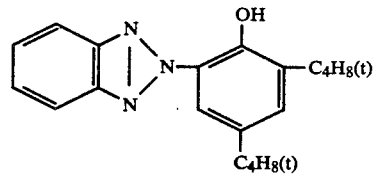

YC-1

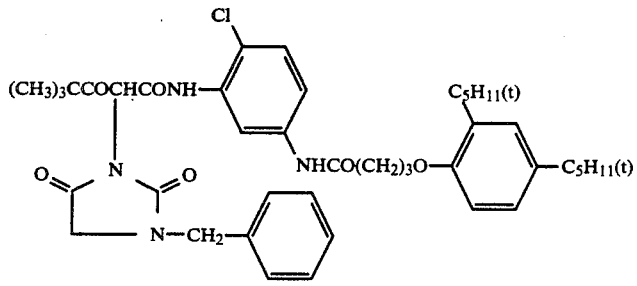

-continued
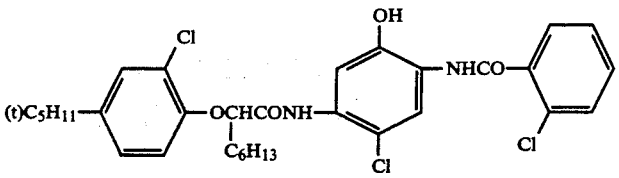
CC-1
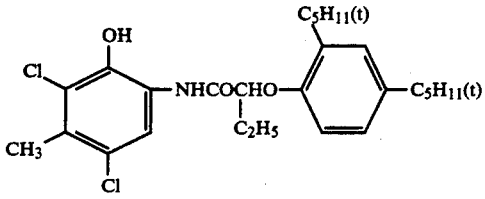
CC-2
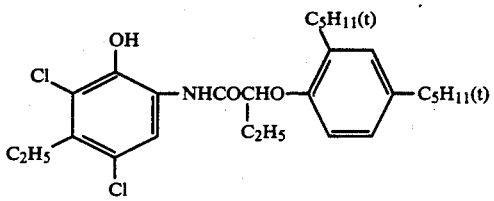
CC-3
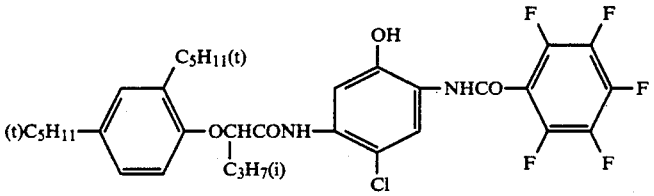
CC-4
Metal Complex 1
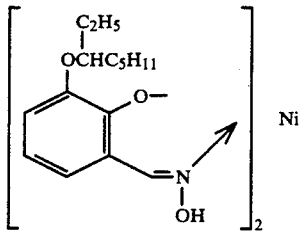
Metal Complex 2
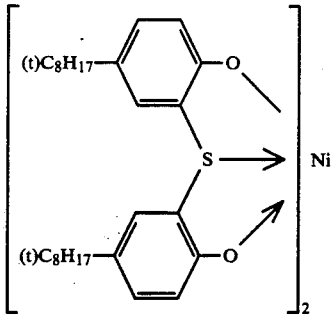
TABLE 6
| Sample | Couplers | | | Third Layer | | Light fastness (%) | | |
|---|---|---|---|---|---|---|---|---|
| No. | Y | M | C | Emulsion | Anti-color-fading agent | Y | M | C |
| 32 (X) | YC-1 | MC-1 | CC-2 | Em-C | — | 87 | 60 | 90 |
| 33 (") | Y-16 | M-10 | " | Em-D | — | 84 | 27 | 91 |
| 34 (") | " | " | " | " | Comparative agent 2 | 85 | 68 | 92 |
| 35 (Y) | " | " | " | " | B-1 | 84 | 71 | 92 |
| 36 (") | " | " | " | Em-B | " | 85 | 72 | 91 |
| 37 (") | " | " | CC-2 + CC-4 | " | " | 85 | 71 | 86 |
| 38 (") | " | " | " | " | B-1 + PH-10 | 85 | 85 | 87 |
| 39 (") | " | " | " | " | B-1 + PH-15 | 84 | 84 | 86 |
| 40 (") | " | " | " | " | B-1 + Metal complex 1 | 84 | 84 | 86 |
| 41 (") | " | " | " | " | B-1 + Metal complex 2 | 84 | 85 | 87 |

TABLE 6-continued

| | | | | | | | | |
|---|---|---|---|---|---|---|---|---|
| 42 (") | " | M-26 | " | " | B-1 + PH-15 | 84 | 87 | 86 |
| 43 (") | " | M-46 | CC-1 + CC-3 | " | B-1 + PH-10 | 83 | 87 | 85 |
| 44 (") | " | M-48 | " | " | " | 83 | 85 | 86 |
| 45 (") | " | M-50 | " | " | " | 84 | 87 | 87 |

| Sample No. | Color-forming performance (Dmax) Y | M | C | Color reproducibility: Secondary absorption density | Stain (Dmin) |
|---|---|---|---|---|---|
| 32 (X) | 2.05 | 1.81 | 2.38 | 0.52 | 0.05 |
| 33 (") | 2.34 | 2.25 | 2.37 | 0.21 | 0.07 |
| 34 (") | 2.33 | 1.98 | 2.39 | 0.22 | 0.06 |
| 35 (Y) | 2.33 | 2.32 | 2.39 | 0.20 | 0.07 |
| 36 (") | 2.35 | 2.31 | 2.40 | 0.20 | 0.05 |
| 37 (") | 2.34 | 2.33 | 2.32 | 0.21 | 0.05 |
| 38 (") | 2.33 | 2.30 | 2.31 | 0.20 | 0.04 |
| 39 (") | 2.36 | 2.35 | 2.31 | 0.20 | 0.05 |
| 40 (") | 2.34 | 2.29 | 2.32 | 0.21 | 0.05 |
| 41 (") | 2.35 | 2.28 | 2.31 | 0.21 | 0.05 |
| 42 (") | 2.36 | 2.29 | 2.32 | 0.20 | 0.05 |
| 43 (") | 2.33 | 2.35 | 2.32 | 0.20 | 0.05 |
| 44 (") | 2.34 | 2.33 | 2.36 | 0.21 | 0.05 |
| 45 (") | 2.35 | 2.31 | 2.36 | 0.20 | 0.05 |

X: Comparative example Y: Present invention

*Samples 37 to 42: CC-2 was coated so as to be in an amount of 1 mg/100 $cm^2$; and CC-4, 3 mg/100 $cm^2$.

*Samples 43 to 45:Both CC-1 and CC-3 were coated so as to be in an amount of 2 mg/100 $cm^2$.

*Amount of the anti-color-fading agent added: Equimolar to magenta coupler, provided that the metal complex was in 0.2 molar amount.

As will be clear from Table 6, the samples of the present invention show good results for all the light-fastness, color-forming performance and color reproducibility, of magenta dye images. There is also attained a good color-fading balance of color-forming balance between the yellow, magenta and cyan images, thus obtaining sharp images.

In contrast thereto, in Sample 34 in which the comparative anti-color-fading agent is used, the color-forming performance is deteriorated although the light-fastness of the magenta image is improved. There is also attained only a poor color-forming balance between the yellow, magenta and cyan images, resulting in the reproduction of a neutral image in a greenish color.

Also, when the phenol type antioxidants or the metal complexes are used as the anti-color-fading agent in combination with the compound of the present invention, the light-fastness of the magenta image is improved and the color-fading by light is well-balanced, thus obtaining favorable results.

What is claimed is:

1. A light-sensitive silver halide photographic material comprising a support having at least one silver halide emulsion layer thereon, wherein at least one said silver halide emulsion layer contains silver halide grains having a silver chloride content of not less than 80 mol %, a magenta dye-forming coupler represented by Formula (M-I), and at least one compound in accordance with Formulas (A) and (B);

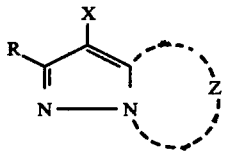

Formula (M-I)

wherein Z represents a group of non-metal atoms necessary to form a nitrogen-containing heterocyclic ring including a substituted ring; X is selected from the group consisting of a hydrogen atom and a group capable of splitting off upon reaction with an oxidation product of a color developing agent; and R represents a hydrogen atom or a substituent;

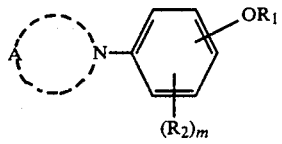

Formula (B)

wherein $R_1$ represents a cycloalkyl group, an alkenyl group, an aryl group, a heterocyclic group, an acyl group, a bridged hydrocarbon group, an alkylsulfonyl group, or an arylsulfonyl group; $R_2$ represents a substituent on a benzene ring, provided that $R_2$ may form a ring together with $OR_1$; m is an integer of 0 to 4, provided that the $R_2$'s may be the same or different when m is 2 or more; and A represents a group of non-metal atoms necessary to form a 5- to 8-membered ring;

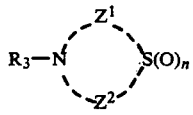

Formula (A)

wherein $R_3$ represents an aryl group or a heterocyclic group; $Z_1$ and $Z_2$ represent independently an alkylene group having 1 to 3 carbon atoms, provided that the total of said carbon atoms is 3 to 6; and n is 1 or 2.

2. The light-sensitive silver halide photographic material of claim 1, wherein said magenta dye-forming coupler has in its chemical structure at least one group selected from a sulfonyl group and a sulfon amide group.

3. The light-sensitive silver halide photographic material of claim 1, wherein said magenta dye-forming coupler has in its chemical structure a group represented by a formula

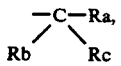

wherein Ra, Rb and Rc independently represent a hydrogen atom or an alkyl group provided that at least two of Ra, Rb and Rc are alkyl groups.

4. The light-sensitive silver halide photographic material of claim 1, wherein said silver halide emulsion layer contains a phenol-type anti-oxidation agent.

5. The light-sensitive silver halide photographic material of claim 2, wherein said silver halide emulsion layer contains a phenol-type anti-oxidation agent.

6. The light-sensitive silver halide photographic material of claim 3, wherein said silver halide emulsion layer contains a phenol-type anti-oxidation agent.

7. The light-sensitive silver halide photographic material of claim 1, wherein said photographic material comprises a compound represented by the formula:

[S]

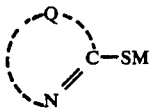

wherein, Q represents a group of atoms necessary to complete a 5-member or 6-member ring which may be condensed with a benzene ring and M represents a hydrogen atom, an alkali metal atom or an ammonium group.

* * * * *